US006942101B2

(12) United States Patent
Lofgren et al.

(10) Patent No.: US 6,942,101 B2
(45) **Date of Patent: *Sep. 13, 2005**

(54) SUSPENSION PACKAGES AND SYSTEMS, AND METHODS OF USING SAME

(75) Inventors: Lewis C. Lofgren, Chicago, IL (US); Carmen Leigh Adams-Kraus, Schererville, IN (US)

(73) Assignee: ADE, Inc., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/803,110

(22) Filed: Mar. 16, 2004

(65) Prior Publication Data

US 2004/0178113 A1 Sep. 16, 2004

Related U.S. Application Data

(63) Continuation-in-part of application No. 10/336,624, filed on Jan. 3, 2003.

(51) Int. Cl.[7] ..... B65D 81/02; B65D 85/30; B65D 85/32

(52) U.S. Cl. ..... 206/583; 206/521; 206/594

(58) Field of Search ..... 206/583, 521, 206/594

(56) References Cited

U.S. PATENT DOCUMENTS

| | | | |
|---|---|---|---|
| 2,031,381 | A | 2/1936 | MaCallum |
| 2,707,553 | A | 5/1955 | Yount |
| 2,802,565 | A | 8/1957 | Kabbash |
| 2,919,797 | A | 1/1960 | McCracken |
| 3,089,590 | A | 5/1963 | Mell |
| 3,424,306 | A | 1/1969 | Munck |
| 3,437,198 | A | 4/1969 | Van Saun et al. |
| 3,507,383 | A | 4/1970 | Rorer |
| 3,540,579 | A | 11/1970 | Hellstrom |
| 3,669,337 | A | 6/1972 | Struble |
| 3,718,275 | A | 2/1973 | Willinger |

(Continued)

FOREIGN PATENT DOCUMENTS

| | | |
|---|---|---|
| CA | 691904 | 8/1964 |
| DE | 299 21 203 U1 | 2/2000 |

(Continued)

OTHER PUBLICATIONS

Sealed Air Corporation Brochure, "Korrvu®: Suspension Packaging and Retention Packaging", Oct. 1999, 7 pages.

*Primary Examiner*—Mickey Yu
*Assistant Examiner*—Faye Francis
(74) *Attorney, Agent, or Firm*—Brinks Hofer Gilson & Lione; Gregory H. Zayia

(57) ABSTRACT

Cushioning-type suspension packages are described that include (a) a product-supporting platform having first and second opposed faces; (b) two end panels, each pivotally connected to a respective end of the product-supporting platform; (c) two side panels, each pivotally connected to a respective side of the product-supporting platform; and (d) an elastomeric enclosure mounted between the two end panels and extending over the first face of the product-supporting platform. The two side panels are configured to pivot towards the first face of the product-supporting platform, such that the two side panels may be configured substantially perpendicular thereto. The two end panels are configured to pivot towards the second face of the product-supporting platform, thereby tensioning the elastomeric enclosure, such that acute angles may be formed between the second face of the product-supporting platform and each of the end panels. Retention-type suspension packages, suspension systems, cushioning panels, and methods of packaging products are also described.

23 Claims, 23 Drawing Sheets

U.S. PATENT DOCUMENTS

| | | | |
|---|---|---|---|
| 3,891,090 | A | 6/1975 | Spiegel et al. |
| 3,905,474 | A | 9/1975 | Haibara |
| 3,966,046 | A | 6/1976 | Deutschlander |
| 4,030,603 | A | 6/1977 | Angell |
| 4,182,224 | A | 1/1980 | Dutcher |
| 4,285,432 | A | 8/1981 | de Villers et al. |
| 4,306,653 | A | 12/1981 | Fales |
| 4,307,804 | A | 12/1981 | Benham |
| 4,494,689 | A | 1/1985 | Ilitch |
| 4,606,460 | A | 8/1986 | Luray |
| 4,632,301 | A | 12/1986 | Slack |
| 4,757,900 | A | 7/1988 | Misset et al. |
| 4,852,743 | A | 8/1989 | Ridgeway |
| 5,086,925 | A | 2/1992 | Coalier et al. |
| 5,211,290 | A | 5/1993 | Janus et al. |
| 5,251,760 | A | 10/1993 | Smith et al. |
| 5,259,507 | A | 11/1993 | Smith |
| 5,323,896 | A | 6/1994 | Jones |
| 5,388,701 | A | 2/1995 | Ridgeway |
| 5,579,917 | A | 12/1996 | Lofgren et al. |
| 5,669,506 | A | 9/1997 | Lofgren et al. |
| 5,678,695 | A | 10/1997 | Ridgeway et al. |
| 5,722,541 | A | 3/1998 | Lofgren et al. |
| 5,823,348 | A | 10/1998 | Phillips et al. |
| 5,839,652 | A | 11/1998 | Ben-Haim |
| 5,855,317 | A | 1/1999 | Dalrymple |
| 5,894,932 | A | 4/1999 | Harding et al. |
| 5,954,263 | A | 9/1999 | Posson |
| 5,967,327 | A | 10/1999 | Jones |
| 5,975,307 | A | 11/1999 | Harding et al. |
| 6,010,006 | A | 1/2000 | Ridgeway et al. |
| 6,119,863 | A | 9/2000 | Lofgren et al. |
| 6,148,591 | A | 11/2000 | Ridgeway et al. |
| 6,158,589 | A | 12/2000 | Smith et al. |
| 6,223,901 | B1 | 5/2001 | Lofgren et al. |
| 6,311,844 | B1 | 11/2001 | Ridgeway et al. |
| 6,467,624 | B1 | 10/2002 | Lofgren et al. |
| 6,675,973 | B1 | 1/2004 | McDonald et al. |
| 2001/0047950 | A1 | 12/2001 | Beneroff et al. |
| 2004/0178113 | A1 | 9/2004 | Lofgren et al. |

FOREIGN PATENT DOCUMENTS

| | | |
|---|---|---|
| DE | 202 17 626 U1 | 1/2003 |
| JP | 49-59982 | 5/1974 |
| JP | 49-77087 | 7/1974 |
| JP | 50-88376 | 7/1975 |
| JP | 50-102778 | 8/1975 |
| JP | 50-107583 | 9/1975 |
| JP | 57-177969 | 11/1982 |
| JP | 3-100158 | 10/1991 |

FIG. 8
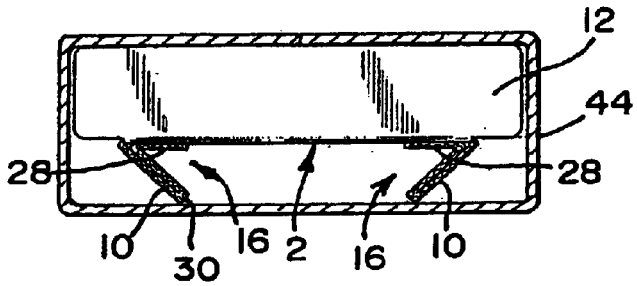
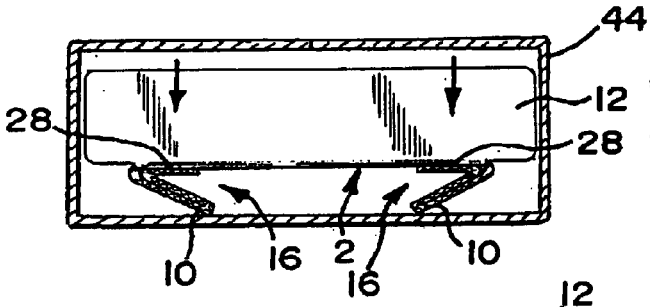
FIG. 9
FIG. 10
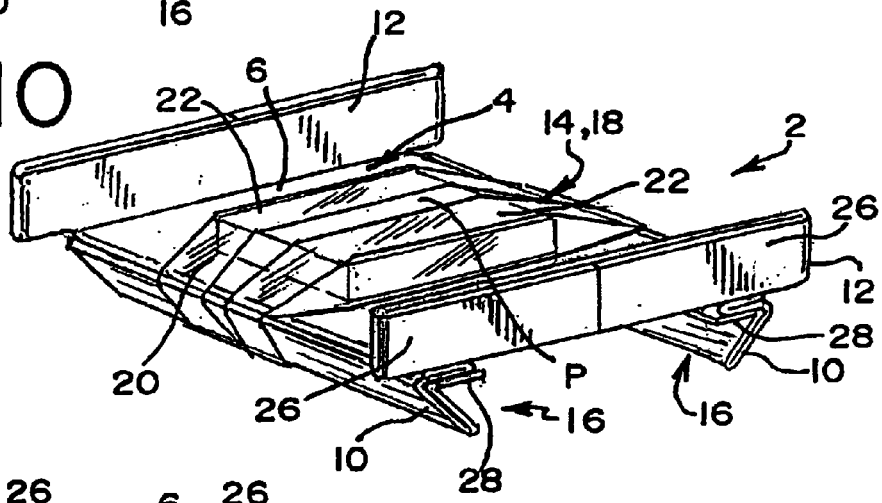
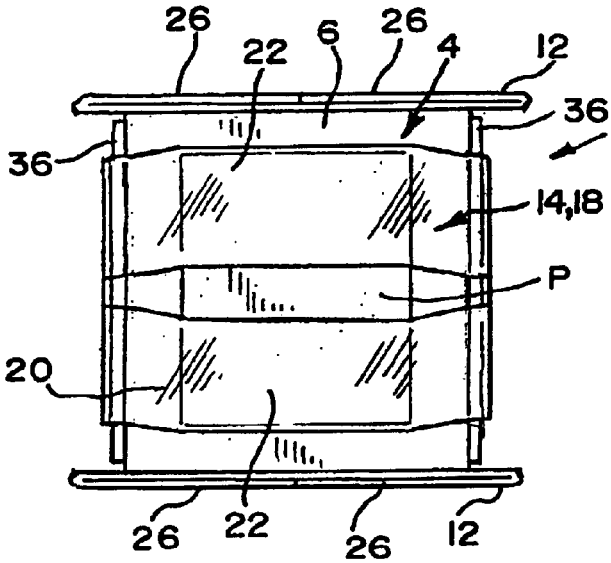
FIG. 11

72
74
76
78
80
82
84
88,128
86,126
104
130
132
134
136
138
69
70
P

SUSPENSION PACKAGES AND SYSTEMS, AND METHODS OF USING SAME

RELATED APPLICATIONS

This application is a continuation-in-part of application Ser. No. 10/336,624, filed Jan. 3, 2003, the entire contents of which are incorporated herein by reference, except that in the event of any inconsistent disclosure or definition from the present application, the disclosure or definition herein shall be deemed to prevail.

FIELD OF THE INVENTION

The present invention relates to suspension packages and, more particularly, to suspension packages for protecting products against shipping damage caused in transit.

BACKGROUND

Various designs of packaging structures have been proposed, including designs having a rigid panel and a flexible film material superimposed thereon. In such designs, an object inserted between the rigid panel and the flexible film material may be held in place against the rigid panel by folding the sides of the structure to tighten the flexible film material against the object. Such immobilization-type packaging structures are described in U.S. Pat. Nos. 5,678,695, 6,010,006, and 6,148,591 to Ridgeway et al. The use of such packaging structures is generally limited to transporting products that are not regarded as being highly breakable but for which immobilization during shipment would be nonetheless desirable (e.g., books, compact discs (CDs), digital video discs (DVDs), and the like). However, there are problems associated with the use of such designs including damage (e.g., scuffing, dulling, etc.) to the object (e.g., the dust jacket of a book) caused by rubbing between the object and the rigid panel, and damage to the object caused in transit when some portion thereof slips out from under the flexible film material and bumps against the sides of the packaging structure and/or the outer container in which the packaging structure is contained.

Additional designs of suspension packages have been proposed, including designs having a frame and a product-restraining hammock extending across a central opening in the frame. When the ends of the frame are folded to be perpendicular thereto in order to tension the hammock, a product may be suspended in the central opening. Such frame-containing suspension packages are described in U.S. Pat. Nos. 5,894,932 and 5,975,307 to Harding et al., both of which are assigned to the assignee of the present invention. While such frame-containing suspension packages are well suited for a variety of applications, such as the transportation of objects that are not regarded as highly breakable, other applications may require more effective protection against certain types of product damage (e.g., damage caused by bottom drops). Typically, applications that require additional protection include the transportation of products that are regarded as highly breakable and/or highly valuable (e.g., electronic components, optical components such as lenses, computers, and the like).

The present invention provides suspension packages and systems and methods for their use which provide solutions to the problems associated with conventional packaging structures.

SUMMARY

The scope of the present invention is defined solely by the appended claims, and is not affected to any degree by the statements within this summary.

By way of introduction, a first suspension package embodying features of the present invention includes: (a) a product-supporting platform having first and second opposed faces; (b) two end panels, each pivotally connected to a respective end of the product-supporting platform; (c) two side panels, each pivotally connected to a respective side of the product-supporting platform; and (d) an elastomeric enclosure mounted between the two end panels and extending over the first face of the product-supporting platform. The elastomeric enclosure is selected from the group consisting of a C-fold hammock, an inverted C-fold hammock, a bellows-fold hammock, a pair of first and second film materials, and combinations thereof. The two side panels are configured to pivot towards the first face of the product-supporting platform, such that the two side panels may be configured substantially perpendicular thereto. The two end panels are configured to pivot towards the second face of the product-supporting platform, thereby tensioning the elastomeric enclosure, such that acute angles may be formed between the second face of the product-supporting platform and each of the end panels.

A second suspension package embodying features of the present invention includes: (a) a product-supporting platform having first and second opposed faces; (b) two end panels, each pivotally connected to a respective end of the product-supporting platform; (c) two side panels, each pivotally connected to a respective side of the product-supporting platform; and (d) an elastomeric enclosure comprising a polymeric film, wherein the elastomeric enclosure is selected from the group consisting of a C-fold hammock, an inverted C-fold hammock, a bellows-fold hammock, a pair of first and second film materials, and combinations thereof, and wherein the elastomeric enclosure is mounted between the two end panels and extends over the first face of the product-supporting platform. The product-supporting platform, the two end panels, and the two side panels are formed from a single sheet of corrugated paperboard. The two side panels are configured to pivot towards the first face of the product-supporting platform, such that the two side panels may be configured substantially perpendicular thereto. The two end panels are configured to pivot towards the second face of the product-supporting platform, thereby tensioning the elastomeric enclosure, such that acute angles may be formed between the second face of the product-supporting platform and each of the end panels.

A third suspension package embodying features of the present invention includes: (a) a product-supporting platform having first and second opposed faces; (b) two end panels, each pivotally connected to a respective end of the product-supporting platform; (c) two side panels, each pivotally connected to a respective side of the product-supporting platform; and (d) an elastomeric enclosure mounted between the two end panels and extending over the first face of the product-supporting platform. The elastomeric enclosure includes a first portion configured to contact the product-supporting platform and a second portion, at least a portion of which is configured to overlie the first portion.

A suspension system embodying features of the present invention includes (a) a suspension package of a type described above, and (b) an outer container for enclosing the suspension package.

A method of packaging a product embodying features of the present invention includes (a) placing the product in a suspension package of a type described above; (b) tensioning the elastomeric enclosure of the suspension package, thereby substantially immobilizing the product; and (c)

placing the suspension package in an outer container dimensioned such that the side panels of the suspension package are held in a configuration substantially perpendicular to the product-supporting platform.

BRIEF DESCRIPTION OF THE DRAWINGS

FIG. 8 shows a cross-sectional side view of the suspension system shown in FIG. 7 under activated conditions taken along the line A—A.

FIG. 9 shows a cross-sectional side view of the suspension system shown in FIG. 7 under bottom-out conditions.

FIG. 10 shows a perspective view of a second cushioning-type suspension package embodying features of the present invention.

FIG. 11 shows a top view of the suspension package shown in FIG. 10.

DETAILED DESCRIPTION

Figure 1:
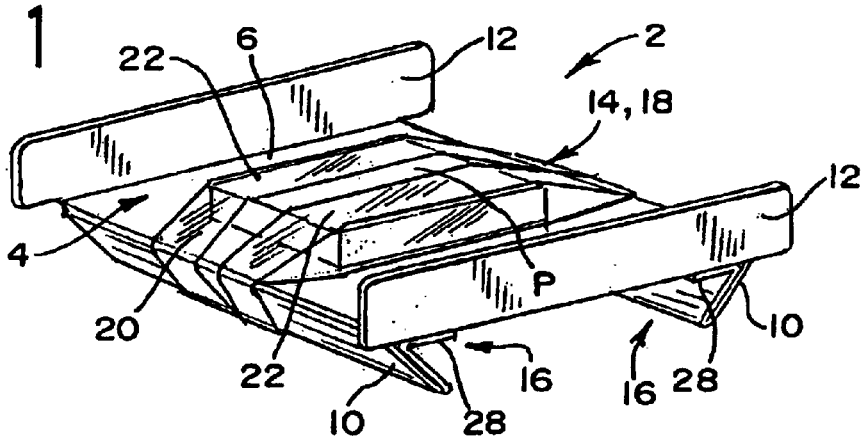
FIG. 1 shows a perspective view of a first cushioning-type suspension package embodying features of the present invention.
Figure 2:
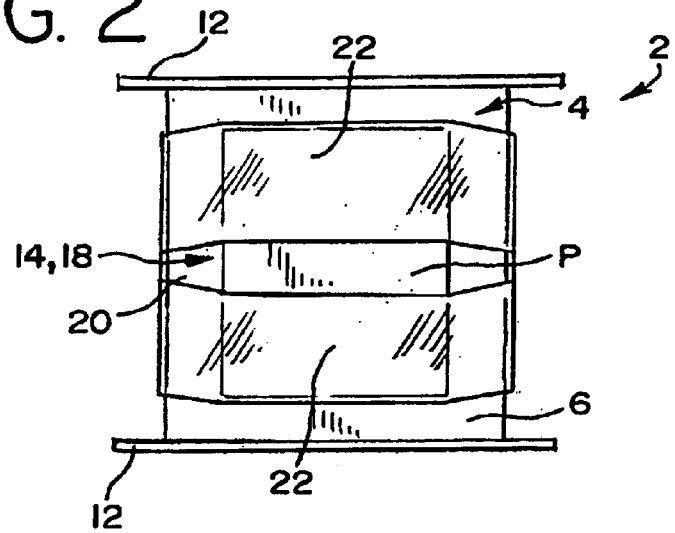
FIG. 2 shows a top view of the suspension package shown in FIG. 1.

It has been discovered that effective protection of products against damage caused by bottom drops, front drops, back drops, and end drops can be achieved with a suspension package that provides a spring-like cushioning effect analogous to that provided by a leaf spring. Such packaging structures are referred to herein as cushioning-type suspension packages. The cushioning effect is controlled by an elastomeric film that has stretchability and memory (i.e., the ability to return to an original shape after deformation), which is suspended across the end panels of the suspension package. When a product is loaded in the suspension package, the suspension package may be activated simply by folding back the end panels, thereby tensioning the elastomeric film and imparting springiness to the end panels. If the suspension package containing the product is subjected to bottom drop, energy imparted to and/or forces acting upon the package during the drop will be absorbed through the spring-like cushioning effect at the end panels. If the suspension package containing the product is subjected to other types of drops, the elastomeric film absorbs energy and/or forces imparted during the drop by accommodating side-to-side and/or upward vertical motion of the product.

It has further been discovered that cushioning panels, which rely on similar spring-cushioning principles as the above-described cushioning-type suspension packages, may be placed around a product within an outer container to absorb shocks and attenuate effects of potentially damaging external shocks.

In addition, it has been discovered that effective protection of products against damage caused by rubbing between an object and a surface against which it is held, as well as damage caused by the partial or complete escape of an object from under a product-restraining member (e.g., a flexible film material), may be achieved with a suspension package that provides an elastomeric enclosure, at least a portion of which is interposed between the object and a product-supporting platform against which it is to be held and/or a surface of an outer container in which the suspension package is to be placed. Such packaging structures are referred to herein as retention-type suspension packages.

Throughout this description and in the appended claims, the following definitions are to be understood:

The phrase "suspension package" refers to packaging structures that provide a cushioning effect of a type described above to minimize or prevent damage to an object contained therein (i.e., cushioning type suspension packages). The phrase also refers to packaging structures that substantially immobilize an object contained therein and which may or may not further provide a cushioning effect (i.e., retention-type suspension packages).

The phrase "elastomeric enclosure" refers to any elastic product retention mechanism, regardless of whether the complete product or only a portion thereof is enclosed in or physically contacts the retention mechanism. Representative presently preferred designs for elastomeric enclosures in accordance with the present invention include but are not limited to hammocks (i.e., materials suspended across distances, which are attached to supports at opposite ends thereof, pairs of overlapping layers, nets (i.e., meshed fabrics which may include a drawstring mechanism for contracting an interior space), and combinations thereof. Presently preferred elastomeric enclosures further described below include hammocks (e.g., C-fold hammocks, inverted C-fold hammocks, bellows-fold hammocks, etc.) and pairs of overlapping layers (e.g., overlapping films or sheets).

Figure 5:
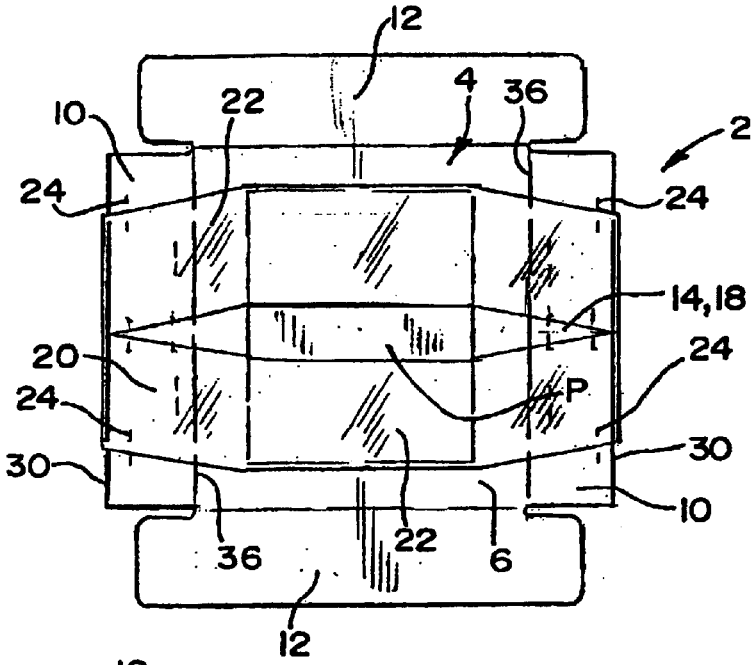
FIG. 5 shows a plan view from the top of the suspension package shown in FIGS. 1–4 under ambient conditions.
Figure 14:
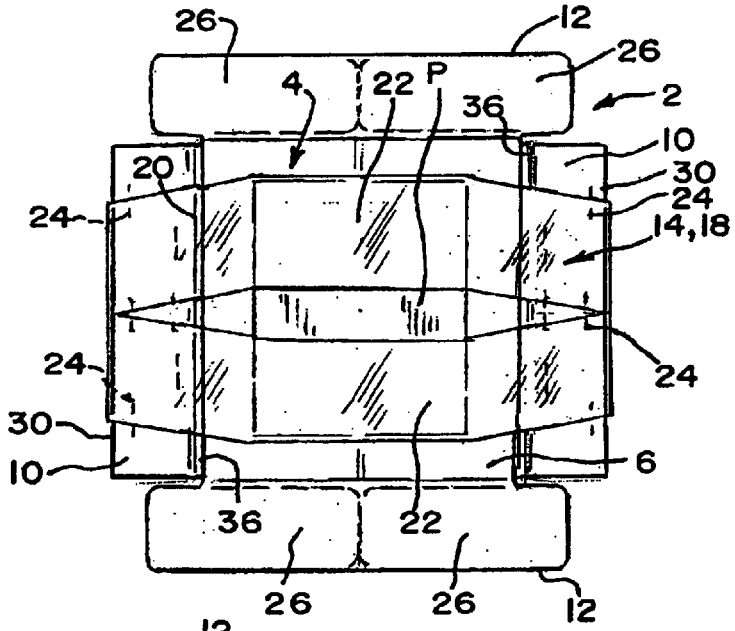
FIG. 14 shows a plan view from the top of the suspension package shown in FIGS. 10–13 under ambient conditions.

The phrase "ambient" or "under ambient conditions" refers to an un-activated (i.e., un-tensioned) state of an empty (i.e., devoid of product) or loaded (i.e., product-containing) suspension package, including but not limited to the substantially flat configurations that may be used during storage or transportation of empty suspension packages (i.e., all elements of the suspension package lie in substantially the same plane, as shown in FIGS. 5 and 14), and to configurations in which one or more portions of the suspension package may resist flattening in the absence of an applied flattening force (e.g., an end panel that is slightly raised due to pulling by the elastomeric member attached thereto).

The phrase "activated" or "under activated conditions" refers to a tensioned state of an empty or loaded suspension package. In the case of cushioning-type suspension packages, activation is achieved by folding back the end panels of the suspension package to form acute angles with the product-supporting platform. In the case of retention-type suspension packages, activation is achieved by folding back the end panels of the suspension package to contact the underside of the product-supporting platform.

The phrase "bottom out" or "under bottom out conditions" refers to a maximum degree of compression that may be applied to a suspension package in an outer container subjected to a bottom drop.

The presently preferred embodiments described herein may possess one or more advantages relative to conventional product packaging, which may include but are but not limited to: ease of use; reduced cost of materials and fabrication; ability to control performance levels through design variation (e.g., length of hinged end panels, number of folds in hinged panels, type of scoring in folds, type of corrugated material, type of elastomeric film, length of elastomeric film, folded width of elastomeric film, etc.); ability to store and/or ship suspension packages in substantially flat configurations, thereby minimizing storage space and shipping costs; reduction in the deflection space required for effective protection against bottom drops; reduction in overall package size; improved protection against end drops; improved consistency of front and back drops through reduction in product twisting in product restraint; improved immobilization of product within product restraint through tighter stretching of elastomeric enclosure around product; minimization of buckling, creasing, and cracking of suspension package; facile immobilization of product within elastomeric enclosure when suspension package is outside container; increased ease of removal of activated suspension package from outer container; minimization or prevention of damage caused by rubbing between an object and a surface against which it is held; and minimization or prevention of damage caused by the partial or complete escape of an object from under a product-restraining member.

Presently preferred embodiments in accordance with the present invention will now be described in reference to the appended drawings. It is to be understood that elements and features of the various representative embodiments described below may be combined in different ways to produce new embodiments that likewise fall within the scope of the present invention. By way of example, elements and features of the cushioning-type suspension packages described herein may be combined with elements and features of the retention-type suspension packages described herein to provide cushioning-type or retention-type suspension packages that likewise fall within the scope of the present invention.

A first series of presently preferred cushioning-type suspension packages embodying features of the present invention is shown in FIGS. 1–9. For the purpose of illustrating a context in which presently preferred embodiments of the present invention may be practiced, a representative product P is depicted in several of the drawing figures. The suspension package 2 includes (a) a product-supporting platform 4 having first and second opposed faces, 6 and 8, respectively; (b) two end panels 10, each pivotally connected to a respective end of the product-supporting platform 4; (c) two side panels 12, each pivotally connected to a respective side of the product-supporting platform 4; and (d) an elastomeric enclosure 14 mounted between the two end panels 10 and extending over the first face 6 of the product-supporting platform 4.

The two side panels 12 are configured to pivot towards the first face 6 of the product-supporting platform 4, such that the two side panels 12 may be configured substantially perpendicular thereto. In alternative embodiments (not shown), the side panels 12 are fixedly connected (rather than pivotally connected) to the respective sides of the product-supporting platform 4. In additional alternative embodiments, the side panels 12 are replaced with one or more spacing elements (not shown), which may be pivotally or fixedly connected to the product-supporting platform 4. The spacing elements may include segmented portions of side panel 12 (e.g., one or more rectangular strips used in place of the contiguous rectangular element comprising side panels 12) or other regular or irregular geometric shapes.

The two end panels 10 are configured to pivot towards the second face 8 of the product-supporting platform 4, thereby stretching the elastomeric enclosure 14, such that acute angles 16 may be formed between the second face 8 of the product-supporting platform 4 and each of the end panels 10. The springiness of an activated end panel 10 is determined by a combination of factors including the length of the end panels 10, the length of the elastomeric enclosure 14, and the folded width of the elastomeric enclosure 14. The elastomeric enclosure 14, preferably selected to have good stretch and recovery characteristics, fulfills at least two roles—namely, that of securing a product P and that of applying spring-like tension to end panels 10.

While not wishing to be bound by a particular theory, nor intending to limit in any measure the scope of the appended claims or their equivalents, it is presently believed that products secured in cushioning-type suspension packages embodying features of the present invention are protected against damage caused by top and edge drops primarily through the action of the elastomeric enclosure 14, and against damage caused by bottom drops primarily through the action of the spring-cushioning effect described above.

Presently preferred designs for achieving the above-mentioned spring-like cushioning effect involve establishing angles that are sufficiently large to prevent the end panels 10 from contacting the second face 8 of the product-supporting platform 4 (e.g., such as in FIGS. 9 and 17 described below), yet not so large as to eliminate the spring-like action of the end panels 10 against a surface (e.g., the bottom of an outer container) on which they rest.

The magnitude of acute angles 16 is not limited. However, it is preferred that acute angles 16 be sufficiently small (e.g., not greater than about 50 degrees, more preferably not greater than about 45 degrees) so that when the suspension package 2 is enclosed in an outer container, there will be a reduced tendency for the end panels 10 to expand to a 90 degree perpendicular orientation with concomitant reduction in desired spring-like cushioning ability. It is especially preferred that the magnitude of acute angles 16 be such that the they will not spring to 90 degrees even after multiple compression and recovery cycles (e.g., bottom drops). Furthermore, it is preferred that acute angles 16 be sufficiently large (e.g., at least 15 degrees, more preferably at least 20 degrees) so that a product P contained in an activated suspension package 2 subjected to a bottom drop will be substantially undamaged (i.e., energy and/or forces imparted by the drop will be substantially absorbed by the spring-like cushioning effect).

The elastomeric enclosure 14 in FIGS. 1–9 is depicted as a C-fold hammock 18 for purpose of illustration. Although hammocks are presently preferred elastomeric enclosures for use with cushioning-type suspension packages embodying features of the present invention, alternative designs may also be used, including but not limited to those described above.

As best seen in FIGS. 1, 2, 4, 5, and 7, the hammock 18 includes a lower portion 20 and at least two upper portions 22 that define a product insertion and removal region. This representative and non-limiting arrangement, known as a C-fold, provides a film that is C-shaped in cross section, which may be used to substantially enclose a product packaged therein. As used herein, the phrase "C-fold hammock" refers to C-shaped hammocks wherein the product insertion and removal region faces away from the product-supporting platform. In contrast, the phrase "inverted C-fold hammock," further described below, refers to C-shaped hammocks in which the product insertion and removal region faces towards the product-supporting platform. The film may include product retention regions, such as welded dots and/or knurled patterns formed by sonic welding, to further restrict movement of a product restrained therein. It should be noted that the degree of separation between the edges of the two upper portions 22 (and, in turn, the size of the opening defining the product insertion and removal region) is not limited. In certain configurations, the two upper portions 22 may be separated by a distance, in contact along an edge, or completely overlapping in their ambient empty or unloaded conditions. Preferably, the width of the two upper portions 22 is sufficiently large, such that the interior region of hammock 18 is capable of substantially enclosing a product (e.g., enveloping the product on at least a portion of each of its sides).

Figure 3:
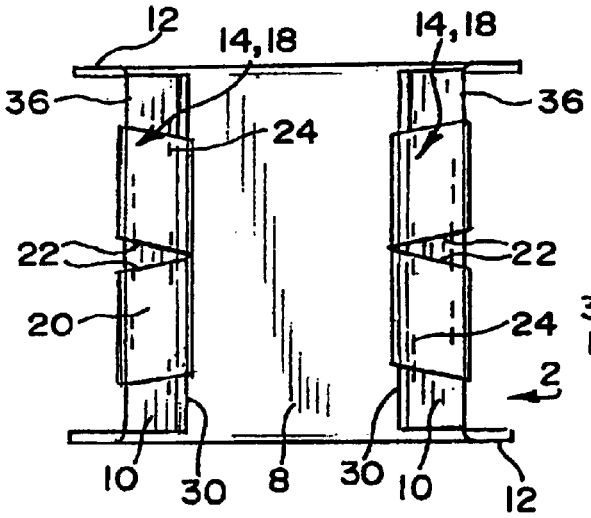
FIG. 3 shows a bottom view of the suspension package shown in FIGS. 1 and 2.
Figure 4:
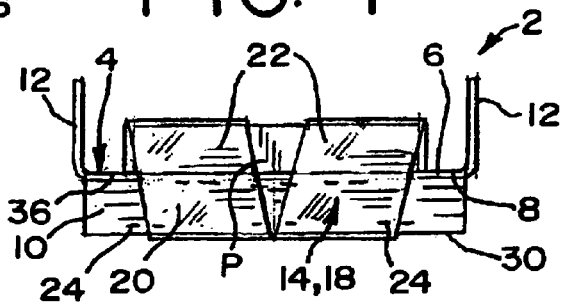
FIG. 4 shows a side view of the suspension package shown in FIGS. 1–3.
Figure 12:
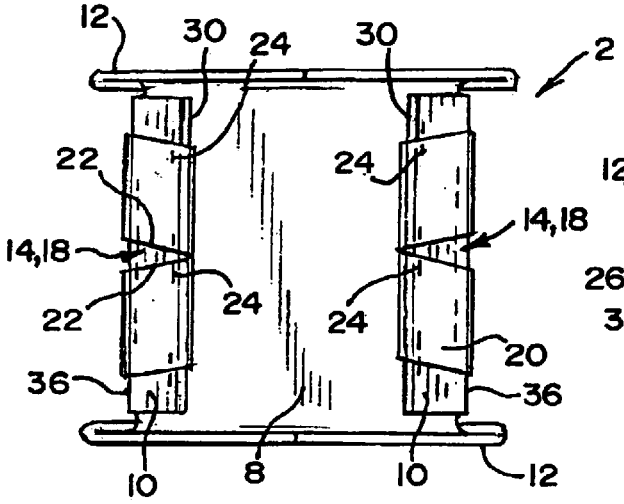
FIG. 12 shows a bottom view of the suspension package shown in FIGS. 10 and 11.
Figure 13:
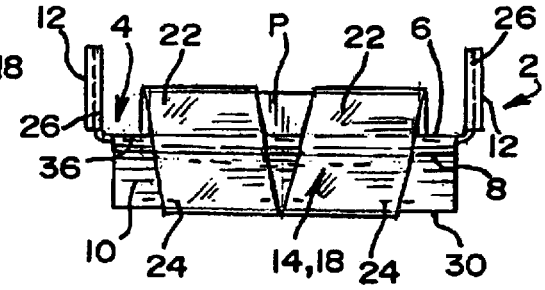
FIG. 13 shows a side view of the suspension package shown in FIGS. 10–12.

The polymeric film forming elastomeric enclosures 14 may be attached to each of the two end panels 10 by any suitable fastener, including but not limited to staples, adhesives, tapes, stitches, and combinations thereof. Staples 24 and adhesives are presently preferred fasteners for use in accordance with the present invention, which may also be used to conveniently secure folded portions of the suspension package. Although the points of attachment of fasteners to the elastomeric enclosure 14 is not limited, it is preferred that the fasteners, for example staples 24, be introduced at opposite ends of elastomeric enclosure 14, more preferably at opposite points defining the furthest distance between the two ends of elastomeric enclosure 14, in order to provide for maximum stretchability of elastomeric enclosure 14. As best shown in FIGS. 3 and 12, the fasteners (e.g., staples 24) may be introduced on the faces of end panels 10 that are adjacent to the second face 8 of product-supporting platform 4. In such a configuration, it is presently preferred that the fasteners (e.g., staples 24) are introduced near an outer edge 30 of end panels 10, on the faces of end panels 10 that are adjacent to the second face 8 of product-supporting platform 4.

As shown in FIGS. 1, 6, 8, and 9, certain presently preferred configurations for cushioning-type suspension packages embodying features of the present invention further include two reinforcing flaps 28, each pivotally connected to an inner edge 36 of the end panels 10, such that the reinforcing flaps 28 are configured to contact the second face 8 of the product-supporting platform 4 when the elastomeric enclosure 14 is tensioned. Reinforcing flaps 28 serve to strengthen the edges of the product-supporting platform 4. In general, reinforcing flaps may be desirable for increasing the tension of the elastomeric enclosure. In addition, reinforcing flaps may be desirable for minimizing or preventing the flattening of the end panels 10 (i.e., for maintaining sufficiently large acute angles 16) when a product P contained in an activated suspension package 2 is subjected to a bottom drop. The use of reinforcing flaps to prevent such flattening may be particularly desirable for use with heavier products P.

Figure 6:
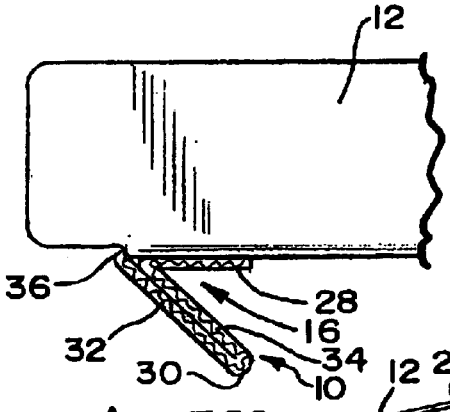
FIG. 6 shows a detailed view of the acute angle formed between the product-supporting platform and an end panel of the suspension package shown in FIGS. 1–5
Figure 7:
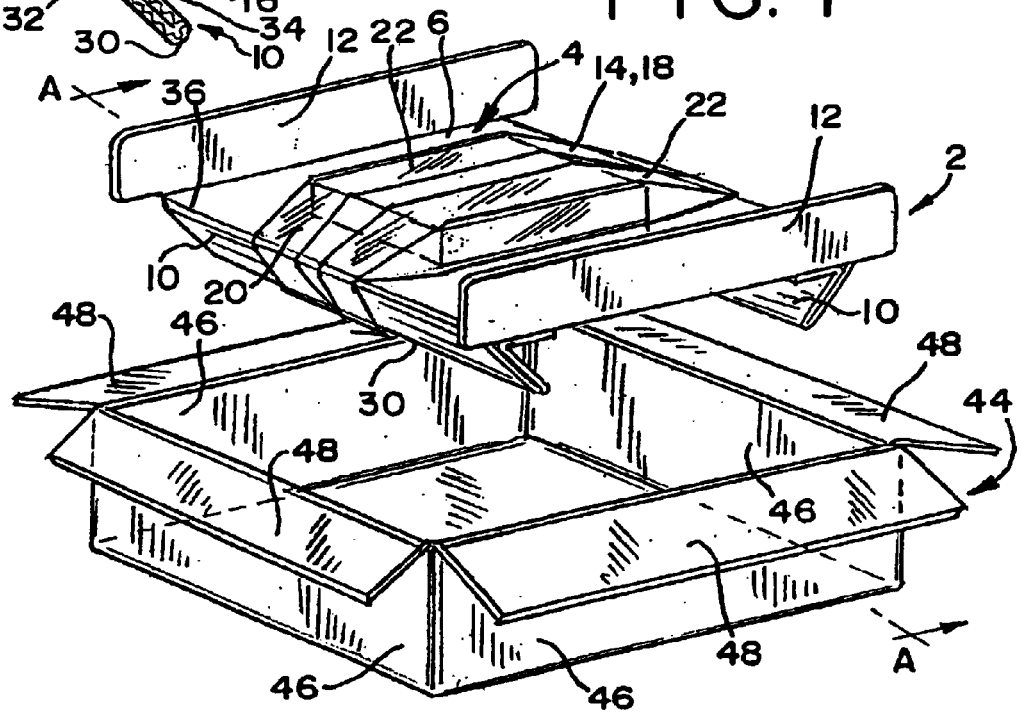
FIG. 7 shows an exploded perspective view of a first cushioning-type suspension system embodying features of the present invention.

In the first series of presently preferred cushioning-type suspension packages shown in FIGS. 1–9, the product-supporting platform 4, the two end panels 10, the two side panels 12, and the two reinforcing flaps 28 are formed from a single sheet of material, with the product-supporting platform 4, the two side panels 12, and the two reinforcing flaps 28 having a single-wall thickness and the two end panels 10 having a double-wall thickness (i.e., the corrugated paperboard forming the end panels 10 has been folded back upon itself). As best shown in FIG. 6, the single sheet of material is folded along the outer edge 30 of the end panel 10, such that first and second opposed layers—32 and 34, respectively—of the double-wall are formed.

Figure 72:
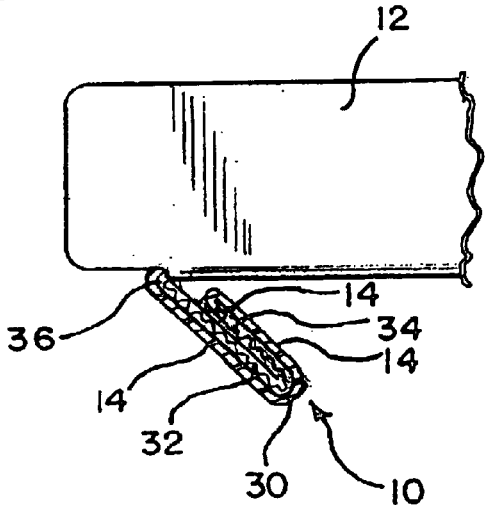
FIG. 72 shows a detailed view of a representative modification to the cushioning-type suspension package shown in FIG. 6.

When cushioning-type suspension packages embodying features of the present invention do not include the reinforcing flaps 28 described above, a presently preferred alternative for attaching the elastomeric enclosure 14 to end panels 10 is shown in FIG. 72. In this alternative configuration, the elastomeric enclosure 14 is sufficiently long to wrap around first layer 32 and second layer 34 of end panel 10, and is secured between these opposing layers, for example with an adhesive.

Figure 15:
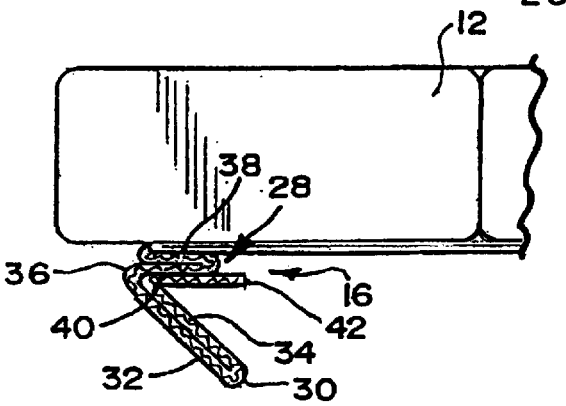
FIG. 15 shows a detailed view of the acute angle formed between the product-supporting platform and an end panel of the suspension package shown in FIGS. 10–14.

A second series of presently preferred cushioning-type suspension packages embodying features of the present invention is shown in FIGS. 10–17. This series differs from the suspension packages shown in FIGS. 1–9 in the folding pattern used to form the end panels 10 and reinforcing flaps 28. The folding pattern used to form the suspension packages shown in FIGS. 10–17 further reinforces the edges of the product-supporting platform 4. As in the first series, the product-supporting platform 4, the two end panels 10, the two side panels 12, and the two reinforcing flaps 28 are formed from a single sheet of material. However, in the embodiments shown in FIGS. 10–17, the product-supporting platform 4 and the two side panels 12 have a single-wall thickness, the two end panels 10 have a double-wall thickness, and the two reinforcing flaps 28 have a triple-wall thickness. As best shown in FIG. 15, the single sheet of material is folded along an inner edge 36 and an outer edge 30 of the end panel 10, such that first and second opposed layers—32 and 34, respectively—of the double-wall are formed, and first, second, and third layers—38, 40, and 42, respectively—of the triple-wall are formed.

Suspension packages embodying features of the present invention may further include side panels 12 having double-wall thickness. Such double-wall thick side panels may be formed starting from double-length single-wall side panels 12, the end portions 26 of which are folded back toward the middle of side panels 12 and secured (e.g., with tape, adhesives, staples, etc.), as best shown in FIG. 14. The end portions 26 of side panels 12 are pivotally connected thereto unless secured as noted above. The double-wall thickness imparted to side panels 12 may provide additional protection against damage caused by certain types of drops.

In the first and second series of presently preferred cushioning-type suspension packages described above, the product-supporting platforms are solid, which is a presently preferred configuration. However, in alternative configurations, one or more portions of the product-supporting platform may be perforated, and/or one or more portions may be removed. Such alternative configurations will now be described in reference to FIGS. 19–24. The suspension packages 2 depicted in these drawings are shown without reinforcing flaps, although it is to be understood that reinforcing flaps may be included and, in certain applications, may be desirable.

Figure 19:
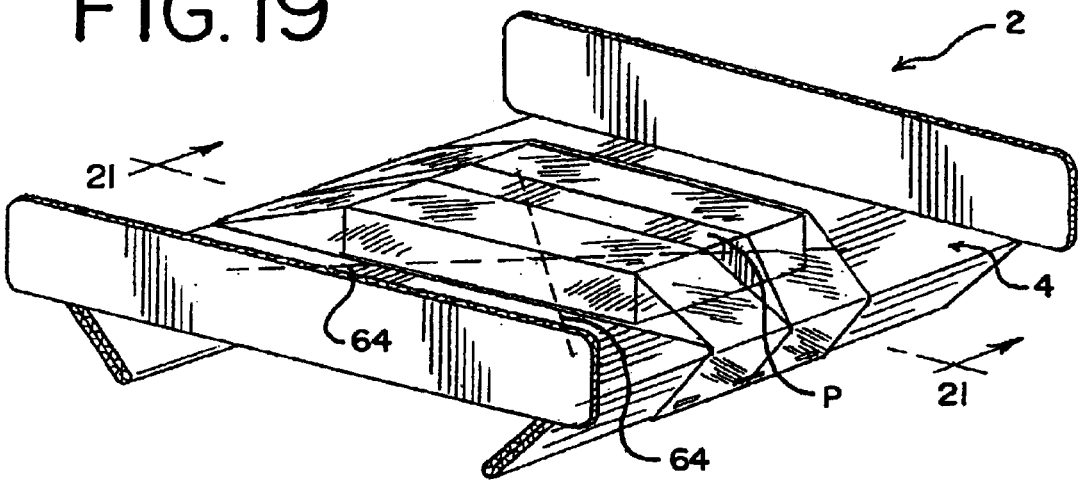
FIG. 19 shows a perspective view of a third cushioning-type suspension package embodying features of the present invention.
Figure 20:
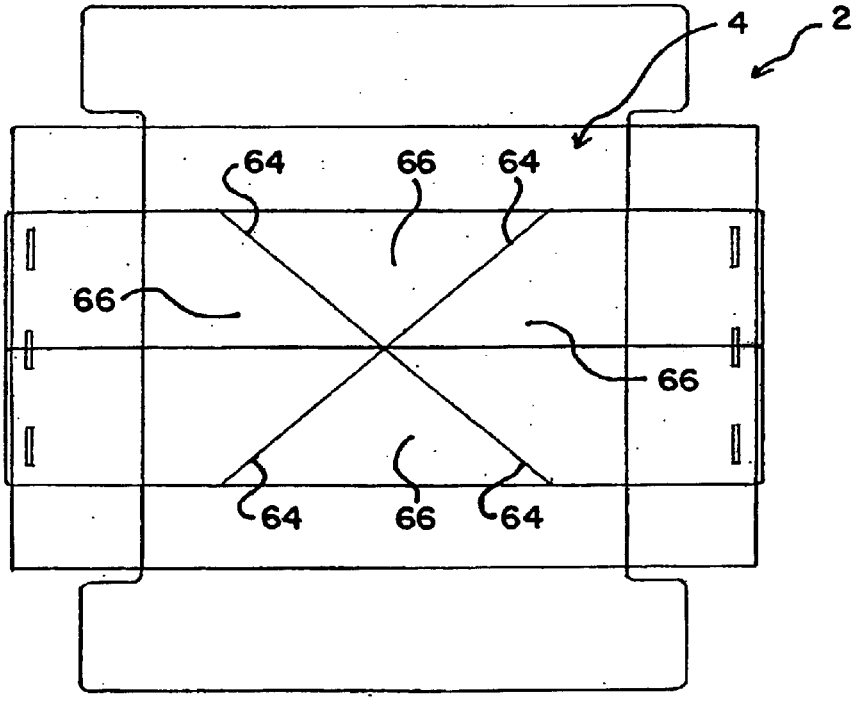
FIG. 20 shows a plan view from the top of the suspension package shown in FIG. 19 under ambient conditions.
Figure 21:
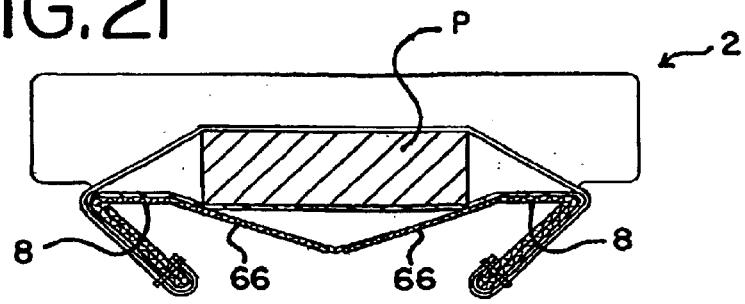
FIG. 21 shows a cross-sectional view of the suspension package shown in FIGS. 19 and 20 taken along the line 21—21.

A third series of presently preferred cushioning-type suspension packages embodying features of the present invention is shown in FIGS. 19–21. This series differs from the suspension packages shown in FIGS. 1–17 in that the product-supporting platform 4 of suspension package 2 is perforated by a plurality of perforations 64 therein, which are configured to form a plurality of flaps 66. In the representative configuration shown in FIGS. 19–21, and best shown by FIG. 20, there are four perforations 64, which are arranged such that four V-shaped flaps 66 are formed thereby. As best shown in FIG. 21, the V-shaped flaps 66 are configured to bend downwards towards the second face 8 of product-supporting platform 4 under the weight of a product P. In addition, products of a certain shape may show a tendency to roll towards the center of the product-supporting platform 4.

Figure 22:
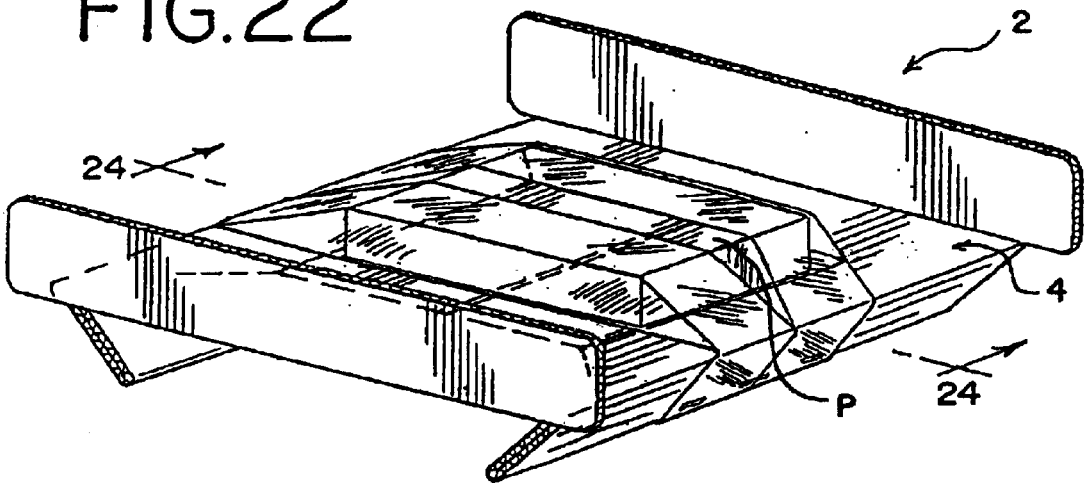
FIG. 22 shows a perspective view of a fourth cushioning-type suspension package embodying features of the present invention.
Figure 23:
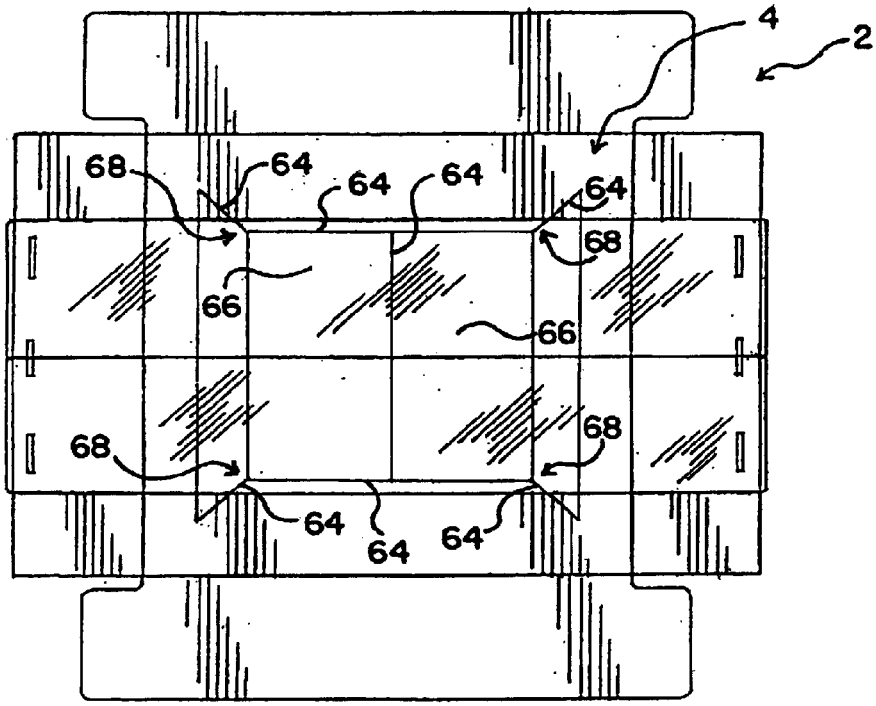
FIG. 23 shows a plan view from the top of the suspension package shown in FIG. 22 under ambient conditions.
Figure 24:
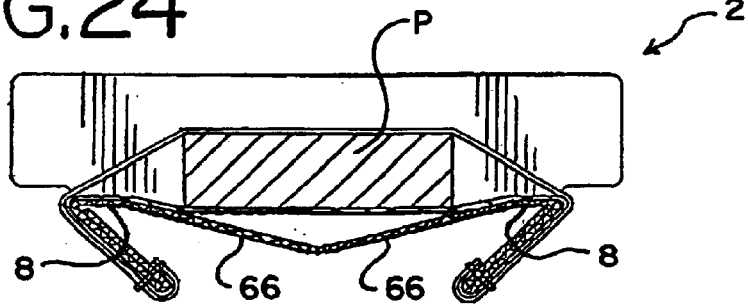
FIG. 24 shows a cross-sectional view of the suspension package shown in FIGS. 22 and 23 taken along the line 24—24.

A fourth series of presently preferred cushioning-type suspension packages embodying features of the present invention is shown in FIGS. 22–24. This series differs from the suspension packages shown in FIGS. 19–21 in the number and arrangement of the perforations 64. In the representative configuration shown in FIGS. 22–24, and best shown by FIG. 23, there are seven perforations 64, which are arranged such that two rectangular shaped flaps 66 are formed thereby. As best shown in FIG. 24, the rectangular shaped flaps 66 are configured to bend downwards towards the second face 8 of product-supporting platform 4 under the weight of a product P. In addition, products of a certain shape may show a tendency to roll towards the center of the product-supporting platform 4.

All manner, number, and arrangement of perforations 64 are contemplated for use in accordance with the present invention, including but not limited to the representative configurations described above. Although it is presently preferred that the product-supporting platform 4 be solid and imperforated, the perforation-containing suspension packages 2 shown in FIGS. 19–24 may be desirable in certain applications (e.g., to better accommodate the shape of a particular product P, etc.). However, perforations 64 in product-supporting platform 4 may reduce the integrity and/or performance of a cushioning-type suspension package 2 subjected to certain types of drops (e.g., 36" bottom drops). By way of example, depending on the material from which product-supporting platform 4 is manufactured, the corners 68 of flaps 66 shown in FIG. 23 may become creased during use, particularly if the object P is large and/or heavy.

In the third and fourth series of presently preferred cushioning-type suspension packages described above, the product-supporting platforms are perforated but intact (i.e., no portions thereof have been removed). However, in alternative configurations (not shown), one or more portions of the product-supporting platform may be removed, such that all or a portion of a product P suspended in the elastomeric enclosure will not come to bear against the product-supporting platform but rather will be suspended over an opening therein. All manner of regular and irregular geometric shapes are contemplated for use in accordance with this opening, including but not limited to circular, square, triangular, rectangular, and substantially product-shaped holes. In a presently preferred configuration, the product-supporting platform has a circular opening that is larger than the product to be packaged.

In the first, second, third, and fourth series of presently preferred cushioning-type suspension packages described above, the elastomeric enclosure 14 mounted between the two end panels 10 extends over the first face 6 of the product-supporting platform 4 without being attached thereto. However, in alternative configurations, all or a portion of a bottom surface of the elastomeric enclosure 14 may be adhered to the first face 6 (e.g., by adhesives, staples, threads or the like, with adhesives being presently preferred). One such alternative configuration will now be described in reference to FIGS. 25–27. The suspension package 2 depicted in these drawings is shown without reinforcing flaps, although it is to be understood that reinforcing flaps may be included and, in certain applications, may be desirable.

Figure 25:
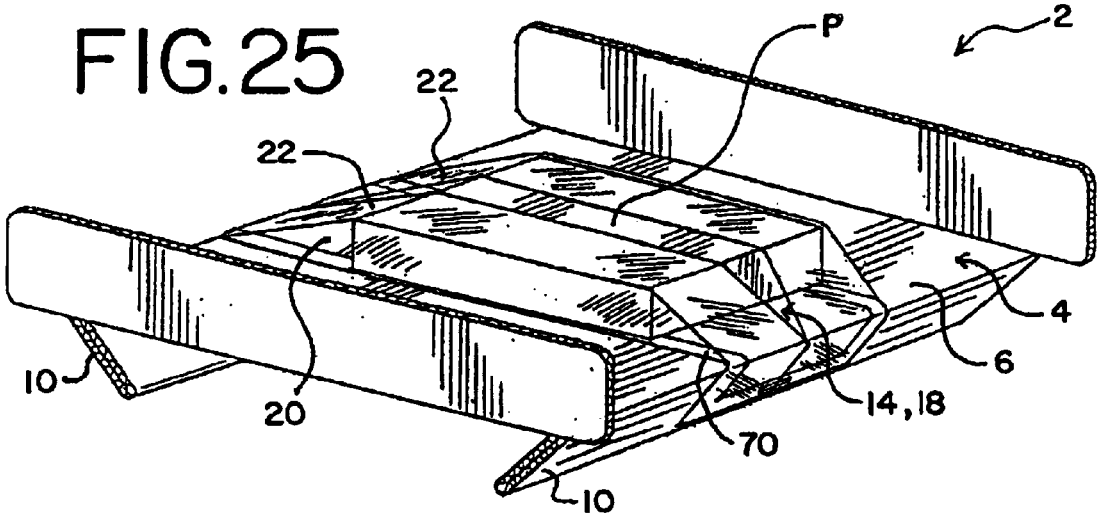
FIG. 25 shows a perspective view of a fifth cushioning-type suspension package embodying features of the present invention.
Figure 26:
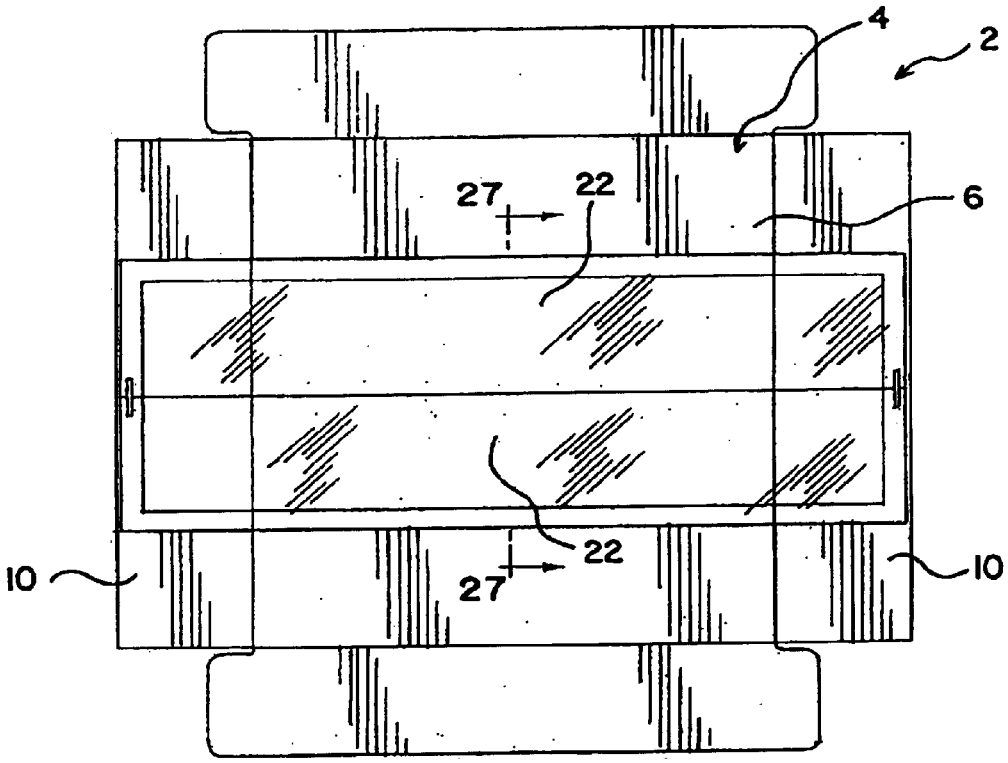
FIG. 26 shows a plan view from the top of the suspension package shown in FIG. 25 under ambient conditions.
Figure 27:
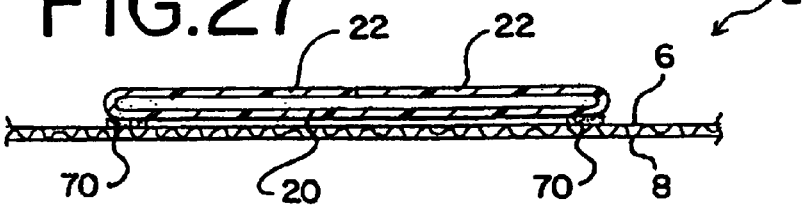
FIG. 27 shows a cross-sectional view of the suspension package shown in FIGS. 25 and 26 taken along the line 27—27.

A fifth series of presently preferred cushioning-type suspension packages embodying features of the present invention is shown in FIGS. 25–27. This series differs from the suspension packages shown in FIGS. 1–24 in that the periphery of a bottom surface of the C-fold hammock 18 is adhered with an adhesive 70 to the first face 6 of the product-supporting platform 4. In an alternative configuration (not shown), substantially the entirety of this bottom surface is adhered to the first face 6. In the representative configuration shown in FIGS. 25–27, and best shown by FIG. 26, a strip of adhesive 70 affixes the periphery of the lower portion 20 of C-fold hammock 18 to the product-supporting platform 4 and end panels 10. Such a configuration is desirable inasmuch as it facilitates grasping of the upper portions 22 of C-fold hammock 18 without simultaneous grasping of the lower portion 20, thereby facilitating product insertion into the hammock 18. All manner of adhesives and alternative attachment mechanisms (e.g., stapling, sewing, and the like) are contemplated for attaching a bottom surface of the elastomeric enclosure to the product-supporting platform, with adhesives being presently preferred agents for use in accordance with the present invention. The adhesive sold under the name FULLER HL-2201-XZP is a presently preferred adhesive.

Figure 28:
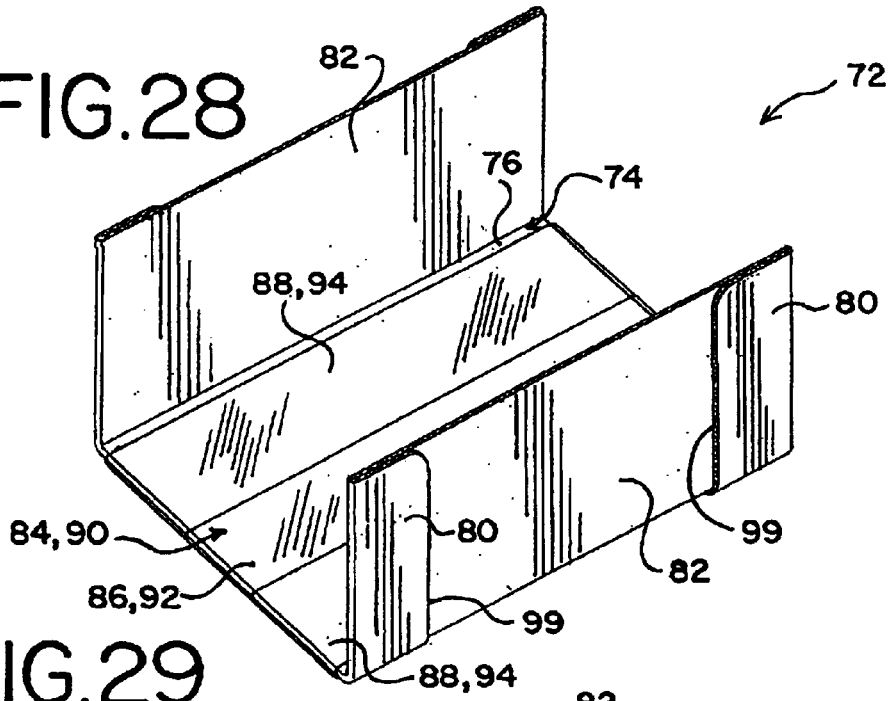
FIG. 28 shows a perspective view of a first retention-type suspension package embodying features of the present invention in a folded condition.
Figure 29:
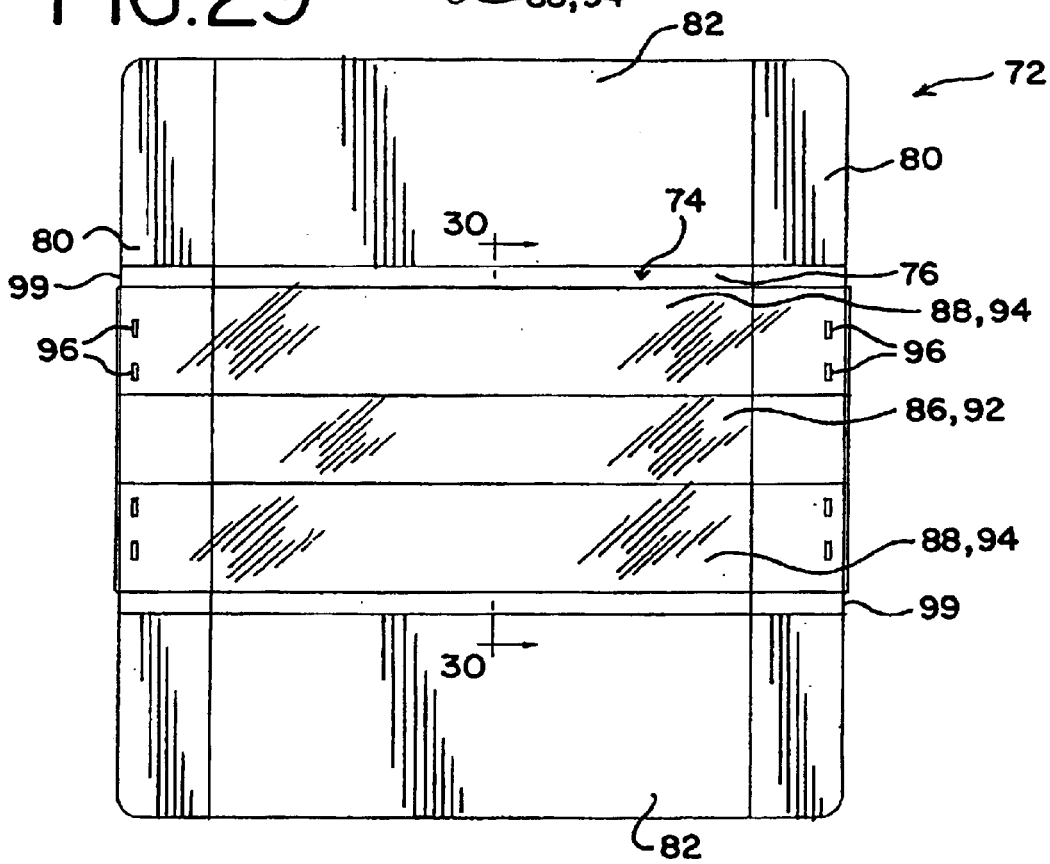
FIG. 29 shows a plan view from the top of the suspension package shown in FIG. 28 under ambient conditions.
Figure 30:
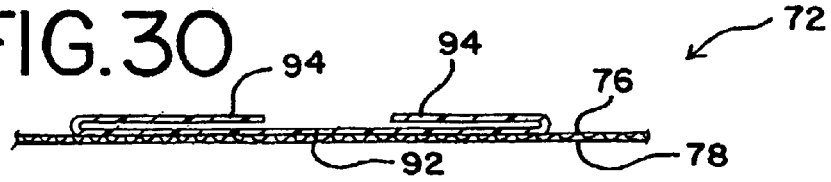
FIG. 30 shows a cross-sectional view of the suspension package shown in FIGS. 28 and 29 taken along the line 30—30.

A first series of presently preferred retention-type suspension packages embodying features of the present invention is shown in FIGS. 28–30. The suspension package 72 includes (a) a product-supporting platform 74 having first and second opposed faces, 76 and 78, respectively; (b) two end panels 80, each pivotally connected to a respective end of the product-supporting platform 74; (c) two side panels 82, each pivotally connected to a respective side of the product-supporting platform 74; and (d) an elastomeric enclosure 84 mounted between the two end panels 80 and extending over the first face 76 of the product-supporting platform 74. The elastomeric enclosure 84 includes a first portion 86 configured to contact the product-supporting platform 74 and a second portion 88, at least a portion of which is configured to overlie the first portion 86. In this configuration, a portion of the elastomeric enclosure 84 will be interposed between a product placed therein and the product-supporting platform 74.

As shown by FIG. 28, the two end panels 80 are configured to pivot towards and contact the second face 78 of the product-supporting platform 74, thereby tensioning the elastomeric enclosure 84.

As further shown by FIG. 28, the two side panels 82 are configured to pivot towards the first face 76 of the product-supporting platform 74, such that the two side panels 82 may be configured substantially perpendicular thereto while the two end panels 80 are substantially in contact with the second face 78 of the product-supporting platform 74. In alternative embodiments (not shown), the side panels 82 are replaced with one or more spacing elements (not shown), which may be pivotally connected to the product-supporting platform 74. The spacing elements may include segmented portions of side panel 82 (e.g., one or more rectangular strips used in place of the contiguous rectangular element comprising side panels 82) or other regular or irregular geometric shapes.

The elastomeric enclosure 84 in FIGS. 28–29 is depicted as a C-fold hammock 90 for purpose of illustration. Presently preferred elastomeric enclosures for use with retention-type suspension packages embodying features of the present invention include hammocks, such as shown in FIGS. 28–29, and pairs of first and second film materials, such as those described below. However, alternative designs such as those described herein may also be used.

When the elastomeric enclosure 84 corresponds to a C-fold hammock 90, as in the presently preferred embodiments shown in FIGS. 28–30, the first portion 86 of elastomeric enclosure 84 corresponds to the lower portion 92 of C-fold hammock 90, and the second portion 88, at least a portion of which is configured to overlie the first portion 86 corresponds to the upper portions 94 of C-fold hammock 90. The elastomeric enclosure 84, which preferably comprises a polymeric film, may include product retention regions, such as welded dots and/or knurled patterns formed by sonic welding, to further restrict movement of a product restrained therein. As described above in connection with cushioning-type suspension packages, the degree of separation between the edges of the two upper portions 94 (and, in turn, the size of the opening defining the product insertion and removal region) is not limited. In certain configurations, the two upper portions 94 may be separated by a distance (e.g., as shown in FIGS. 28–30), in contact along an edge, or completely overlapping in their ambient empty or unloaded conditions. Preferably, the width of the two upper portions 94 is sufficiently large, such that the interior region of hammock 90 is capable of substantially enclosing a product (e.g., enveloping the product on at least a portion of each of its sides).

The polymeric film forming elastomeric enclosure 84 may be attached to each of the two end panels 80 by any suitable fastener, including but not limited to staples, adhesives, tapes, stitches, and combinations thereof. Staples 96 and adhesives are presently preferred fasteners for use in accordance with the present invention, which may optionally be used to secure folded portions of the suspension package 72. Although the points of attachment of fasteners to the elastomeric enclosure 84 is not limited, it is preferred that the fasteners, for example staples 96, be introduced at opposite ends of elastomeric enclosure 84, more preferably at opposite points defining the furthest distance between the two ends of elastomeric enclosure 84.

If the elastomeric enclosure 84 is longer than the combined lengths of the product-supporting platform 74 and the two end panels 80, one or both ends of the elastomeric enclosure 84 may be wrapped around end panels 80 so as to contact the faces of end panels 80 that are adjacent to the second face 78 of product-supporting platform 4. In such a configuration, one or more fasteners (e.g., adhesives, staples 96, etc.) may be used to fasten the ends of the elastomeric enclosure 84 to the end panels 80 by introducing the fasteners near an outer edge 99 of end panels 80 on the faces thereof adjacent to the second face 78 of product-supporting platform 74. However, if the elastomeric enclosure 84 is approximately the same length as the combined lengths of the product-supporting platform 74 and the two end panels 80, the ends of the elastomeric enclosure 84 may be fastened (e.g., with adhesives and/or staples 96, etc.) to the end panels 80 on the faces thereof adjacent to the first face 76 of product-supporting platform 4, preferably near an outer edge 99 of the end panels 80.

In the first series of presently preferred retention-type suspension packages shown in FIGS. 28–30, the product-supporting platform 74, the two end panels 80, and the two side panels 82 are formed from a single sheet of material, with each portion having a single-wall thickness.

In the first series of presently preferred retention-type suspension packages shown in FIGS. 28–30 and described above, the product-supporting platform is solid, which is a presently preferred configuration. However, in alternative configurations, one or more portions of the product-supporting platform may be perforated, and/or one or more portions may be removed. Such alternative configurations are described below in reference to FIGS. 31–39, and 49–57.

Figure 31:
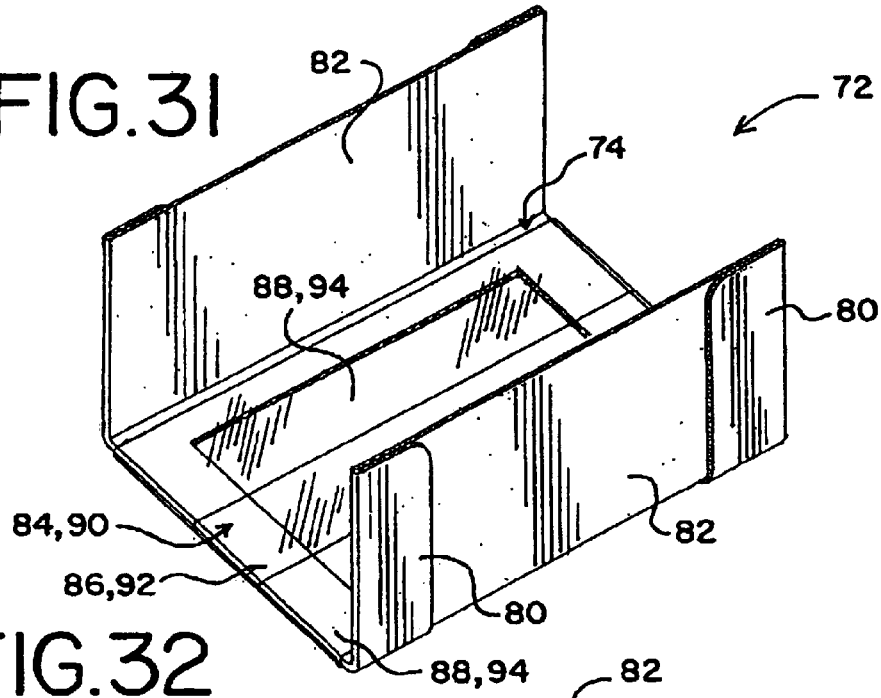
FIG. 31 shows a perspective view of a second retention-type suspension package embodying features of the present invention in a folded condition.
Figure 32:
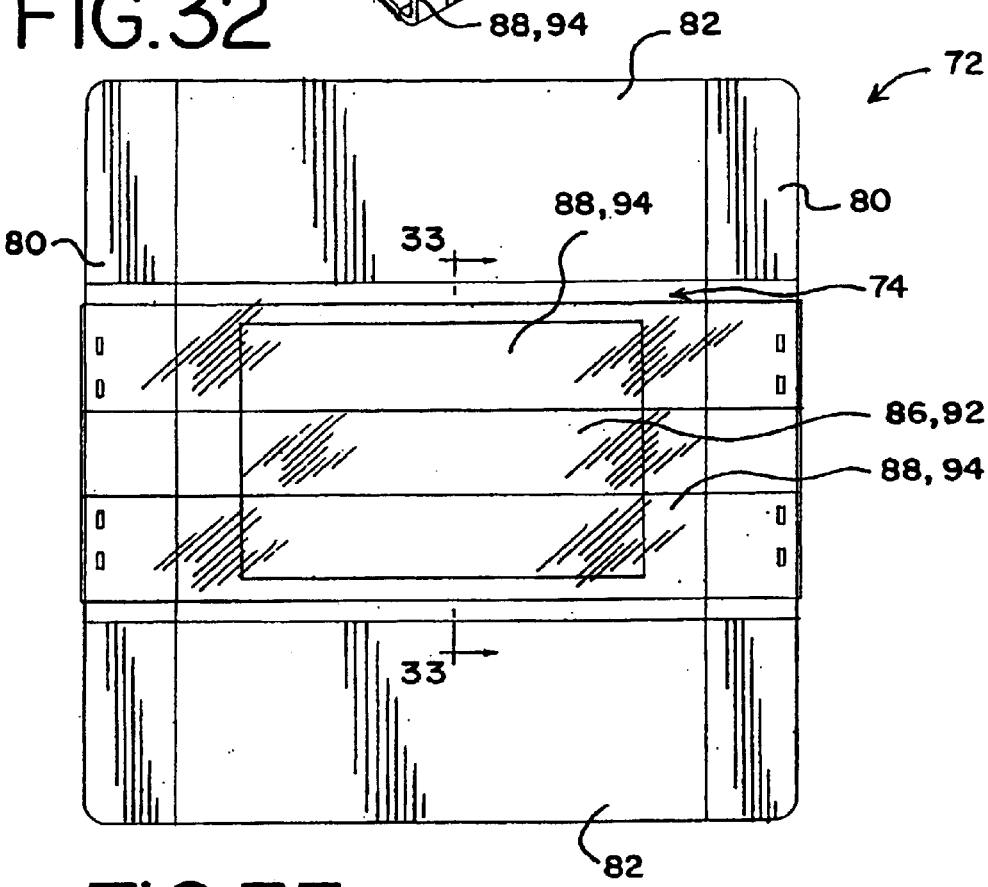
FIG. 32 shows a plan view from the top of the suspension package shown in FIG. 31 under ambient conditions.
Figure 33:
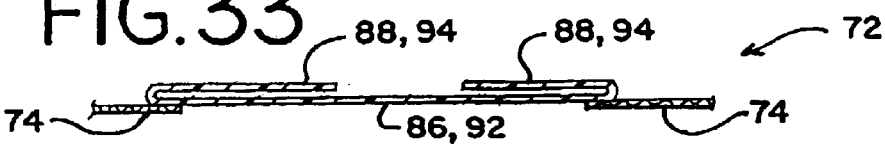
FIG. 33 shows a cross-sectional view of the suspension package shown in FIGS. 31 and 32 taken along the line 33—33.

A second series of presently preferred retention-type suspension packages embodying features of the present invention is shown in FIGS. 31–33. This series differs from the suspension packages shown in FIGS. 28–30 in that a portion of the product-supporting platform 74 has been removed to provide a rectangular opening therein, such that all or a portion of a product suspended in the elastomeric enclosure 84, depicted in FIGS. 31–33 as a C-fold hammock 90 for purposes of illustration, will not come to bear against the product-supporting platform 74 but rather will be suspended over the opening. Although the opening shown in FIGS. 31–33 has a rectangular shape, alternative geometries may likewise be employed. All manner of regular and irregular geometric shapes are contemplated for use in accordance with this opening, including but not limited to circular, square, triangular, rectangular, and substantially product-shaped holes.

Figure 34:
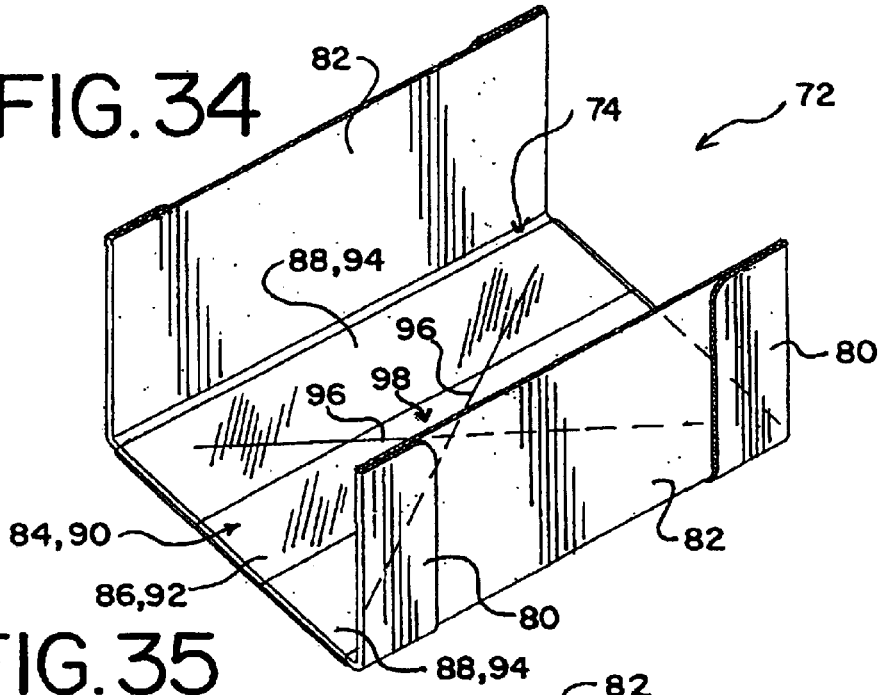
FIG. 34 shows a perspective view of a third retention-type suspension package embodying features of the present invention in a folded condition.
Figure 35:
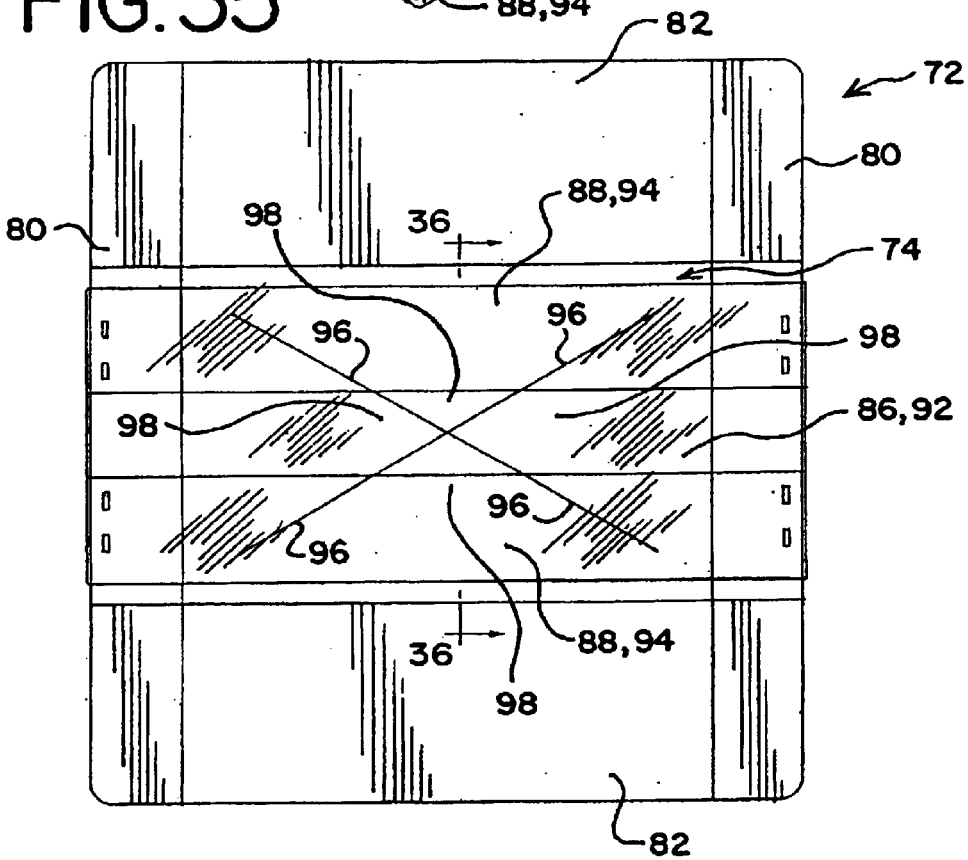
FIG. 35 shows a plan view from the top of the suspension package shown in FIG. 34 under ambient conditions.
Figure 36:
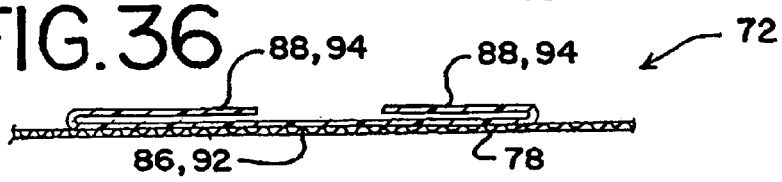
FIG. 36 shows a cross-sectional view of the suspension package shown in FIGS. 34 and 35 taken along the line 36—36.

A third series of presently preferred retention-type suspension packages embodying features of the present invention is shown in FIGS. 34–36. This series differs from the suspension packages shown in FIGS. 28–33 in that the product-supporting platform 74 of suspension package 72 is perforated by a plurality of perforations 96 therein, which are configured to form a plurality of flaps 98. In the representative configuration shown in FIGS. 34–36, and best shown by FIG. 35, there are four perforations 96, which are arranged such that four V-shaped flaps 98 are formed thereby. The V-shaped flaps 98 are configured to bend downwards towards the second face 78 of product-supporting platform 74 under the weight of a product. In addition, products of a certain shape may show a tendency to roll towards the center of the product-supporting platform 74.

Figure 37:
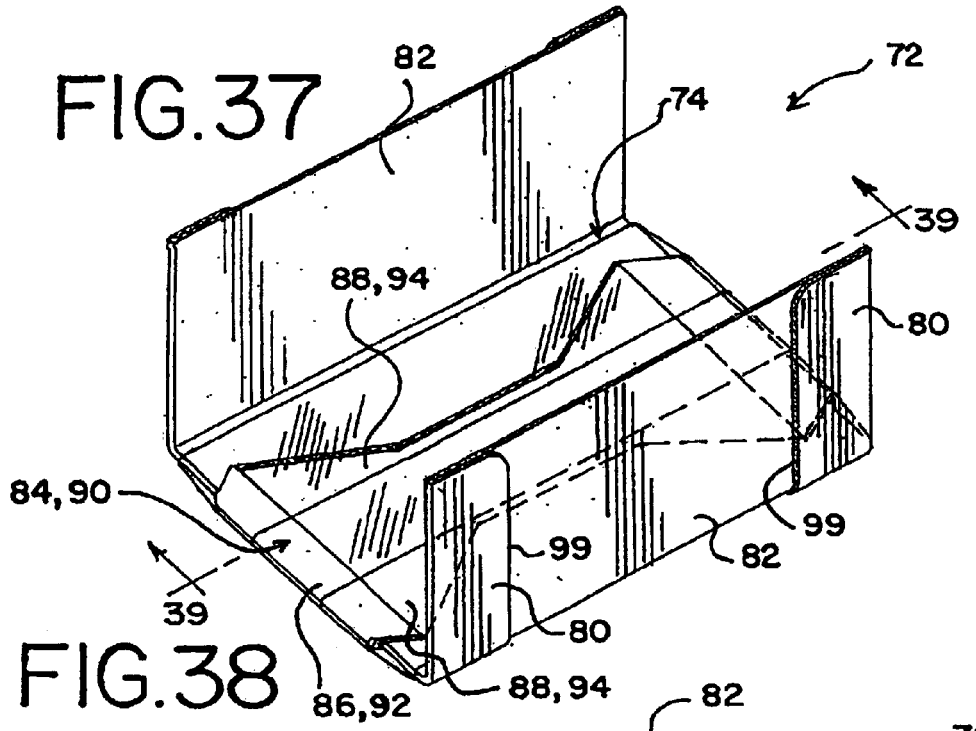
FIG. 37 shows a perspective view of a fourth retention-type suspension package embodying features of the present invention in a folded condition.
Figure 38:
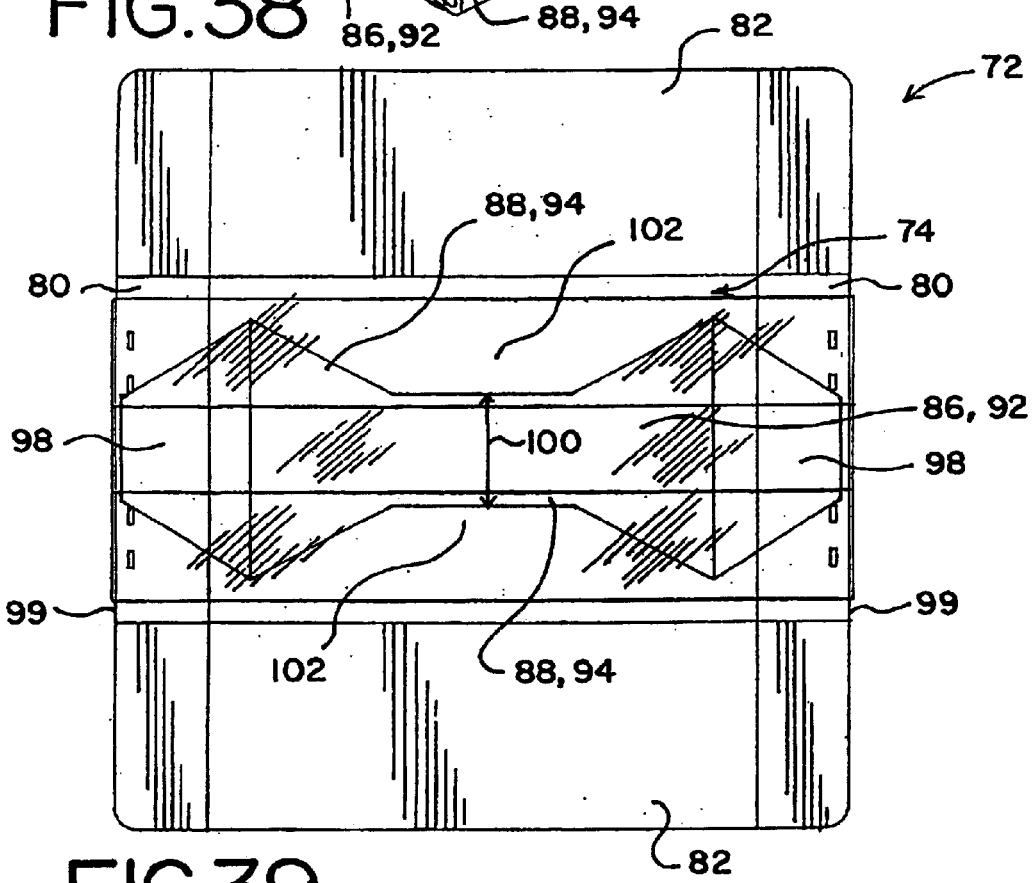
FIG. 38 shows a plan view from the top of the suspension package shown in FIG. 37 under ambient conditions.
Figure 39:
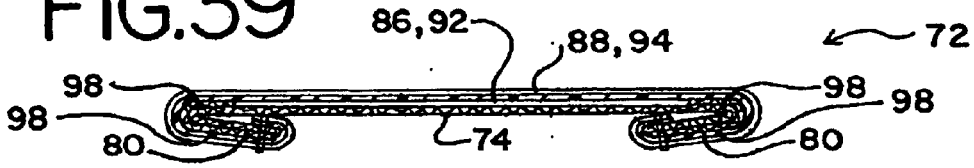
FIG. 39 shows a cross-sectional view of the suspension package shown in FIGS. 37 and 38 taken along the line 39—39.

A fourth series of presently preferred retention-type suspension packages embodying features of the present invention is shown in FIGS. 37–39. This series differs from the suspension packages shown in FIGS. 28–36 in that a first portion of the product-supporting platform 74 has been removed and a second portion of the product-supporting platform 74 has been perforated to form flaps 98 that are folded onto the outer edges 99 of end panels 80 and held in place under the elastomeric enclosure 84. Such a folded configuration is desirable inasmuch as the flaps 98 serve to reinforce the sides of the product-supporting platform 74. In the suspension packages shown in FIGS. 37–39, all or a portion (depending on the size and/or shape) of a product suspended in the elastomeric enclosure 84, depicted in FIGS. 37–39 as a C-fold hammock 90 for purposes of illustration, will not come to bear against the product-supporting platform 74 but rather will be suspended over the opening. Although the opening shown in FIGS. 37–38 has a bowtie shape, alternative geometries may likewise be employed. All manner of regular and irregular geometric shapes are contemplated for use in accordance with this opening, including but not limited to circular, square, triangular, rectangular, and substantially product-shaped holes. Products larger than the narrowest width 100 of the opening in product-supporting platform 74 may bear against and subsequently bend lengthwise portions 102 of product-supporting platform 74 in a direction towards the second face 78 of product-supporting platform 74.

In the first, second, third, and fourth series of presently preferred retention-type suspension packages described above, the elastomeric enclosure 84 mounted between the two end panels 80 extends over the first face 76 of the product-supporting platform 74 without being attached thereto. However, in alternative configurations, all or a portion of a bottom surface of the elastomeric enclosure 84 may be adhered to the first face 76 (e.g., by adhesives, staples, threads or the like, with adhesives being presently preferred). Such alternative configurations are described below in reference to FIGS. 40–42, and 61–66.

Figure 40:
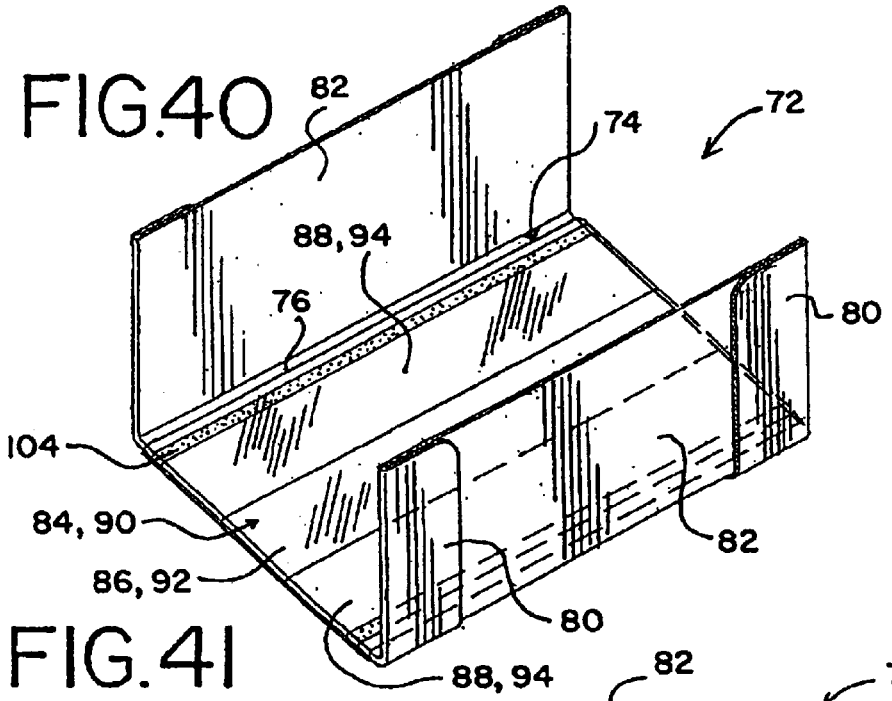
FIG. 40 shows a perspective view of a fifth retention-type suspension package embodying features of the present invention in a folded condition.
Figure 41:
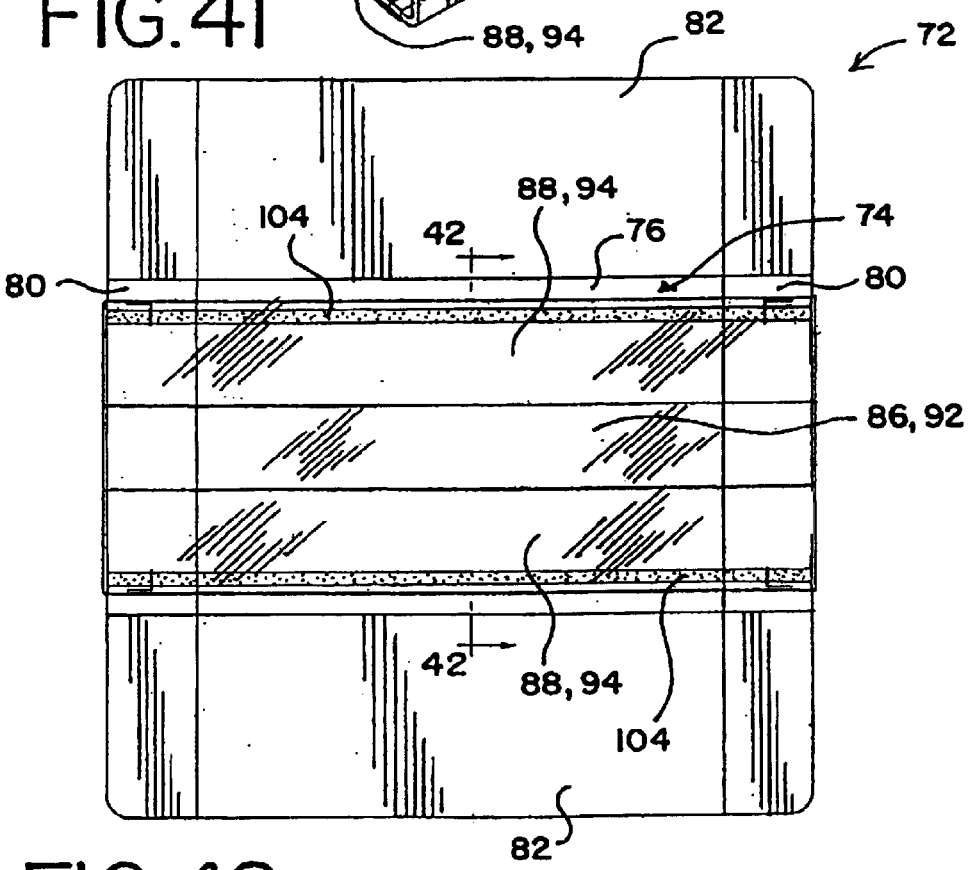
FIG. 41 shows a plan view from the top of the suspension package shown in FIG. 40 under ambient conditions.
Figure 42:
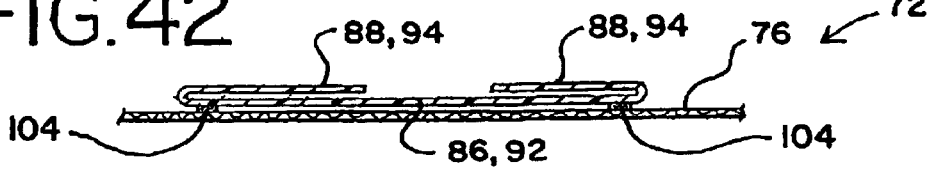
FIG. 42 shows a cross-sectional view of the suspension package shown in FIGS. 40 and 41 taken along the line 42—42.

A fifth series of presently preferred retention-type suspension packages embodying features of the present invention is shown in FIGS. 40–42. This series differs from the suspension packages shown in FIGS. 28–39 in that the lengthwise portions of a bottom surface of the elastomeric enclosure 84, depicted in FIGS. 40–42 as a C-fold hammock 90 for purposes of illustration, are adhered with an adhesive 104 to the first face 76 of the product-supporting platform 74 and to the end panels 80. In an alternative configuration (not shown), substantially the entirety of this bottom surface is adhered to the first face 76 and/or to end panels 80. In the representative configuration shown in FIGS. 40–42, and best shown by FIG. 41, a strip of adhesive 104 affixes the lengthwise portions of the lower portion 92 of C-fold hammock 90 to the product-supporting platform 74. Such a configuration is desirable inasmuch as it facilitates grasping of the upper portions 94 of C-fold hammock 90 without simultaneous grasping of the lower portion 92, thereby facilitating product insertion into the hammock 90. All manner of adhesives and alternative attachment mechanisms (e.g., stapling, sewing, and the like) are contemplated for attaching a bottom surface of the elastomeric enclosure to the product-supporting platform and/or to the end panels, with adhesives being presently preferred agents for use in accordance with the present invention. The adhesive sold under the name FULLER HL-2201-XZP is a presently preferred adhesive.

Figure 43:
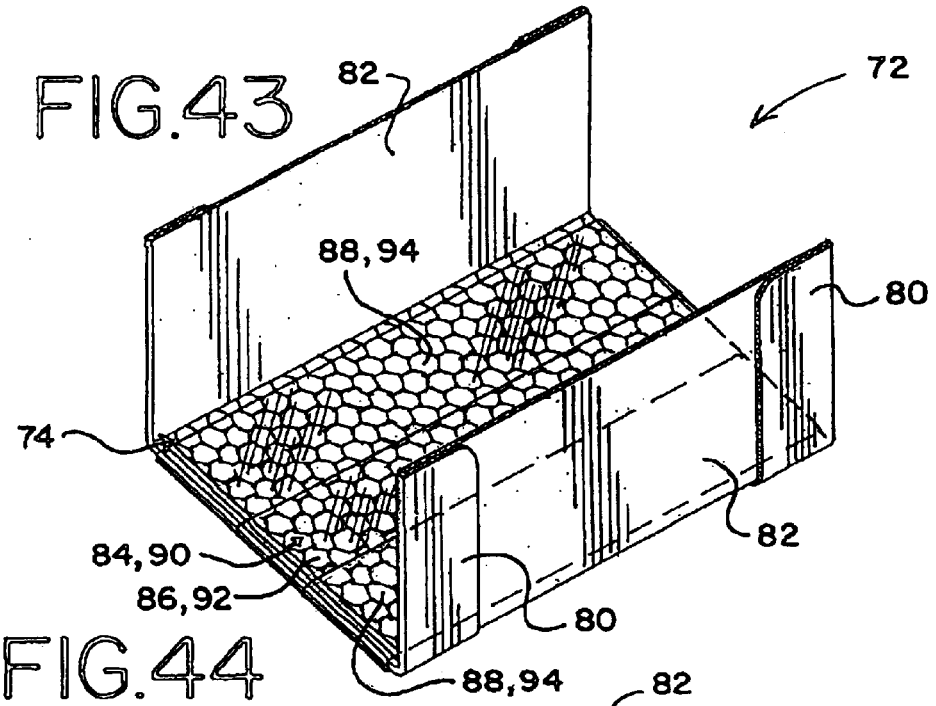
FIG. 43 shows a perspective view of a sixth retention-type suspension package embodying features of the present invention in a folded condition.
Figure 44:
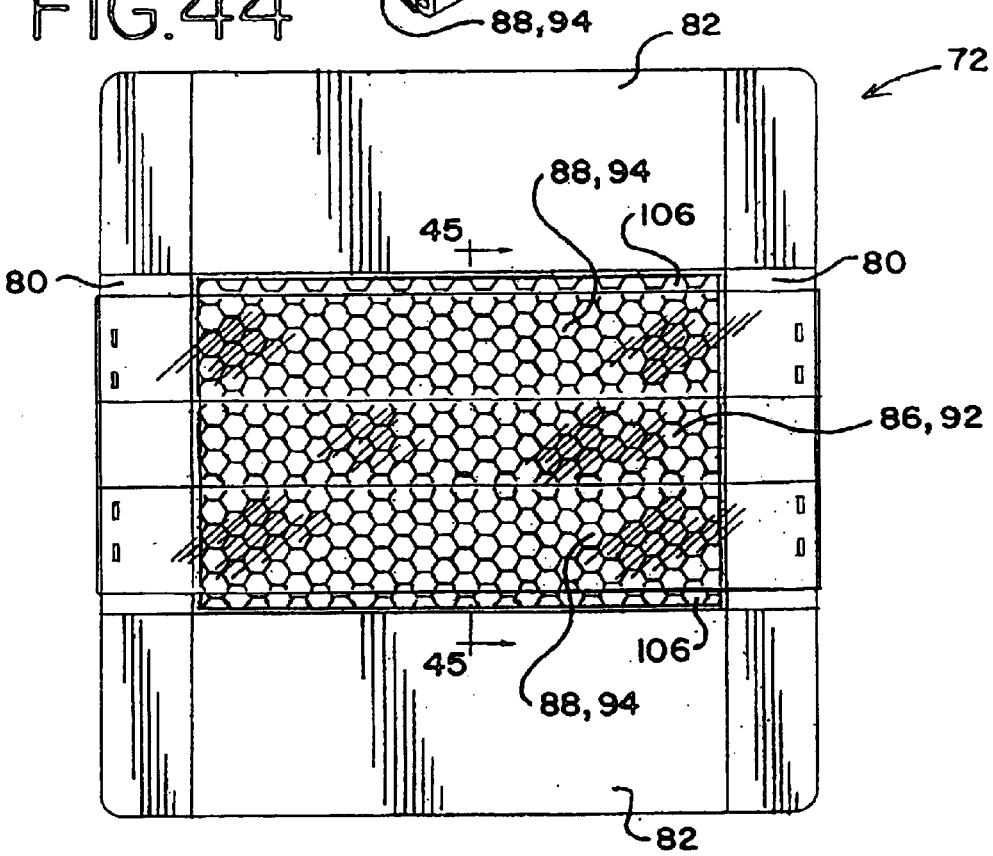
FIG. 44 shows a plan view from the top of the suspension package shown in FIG. 43 under ambient conditions.
Figure 45:
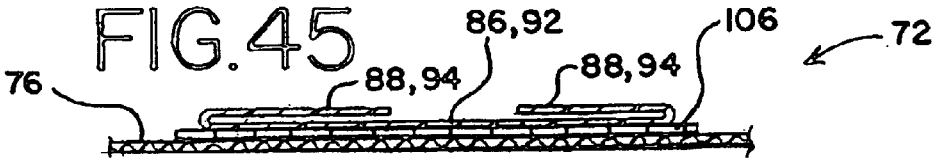
FIG. 45 shows a cross-sectional view of the suspension package shown in FIGS. 43 and 44 taken along the line 45—45.

A sixth series of presently preferred retention-type suspension packages embodying features of the present invention is shown in FIGS. 43–45. This series differs from the suspension packages shown in FIGS. 28–42 in that a cushioning layer 106 is attached to the first face 76 of the product-supporting platform 74. The cushioning layer 106 is interposed between the product-supporting platform 74 and the first portion 86 of the elastomeric enclosure 84, depicted in FIGS. 43–45 as a C-fold hammock 90 for purposes of illustration. Such a configuration is desirable inasmuch as cushioning layer 106 provides additional protection against damage to a product contained in the elastomeric enclosure 84. All manner of shapes, sizes, and materials are contemplated for use in accordance with cushioning layer 106. Presently preferred materials for cushioning layer 106 include but are not limited to bubble wrap, shown in FIGS. 43–45 for purposes of illustration, as well as foam, cotton, felt, and the like. It should be noted that in the suspension packages shown in FIGS. 43–45, the first portion 86 of elastomeric enclosure 84 remains interposed between a product contained in the elastomeric enclosure 84 and both the cushioning layer 106 and the product-supporting platform 74.

In the first through sixth series of presently preferred retention-type suspension packages described above, the elastomeric enclosures 84 correspond to C-fold hammocks 90, which are presently preferred configurations. However, in alternative configurations, the elastomeric enclosures 84 correspond to pairs of first and second film materials. Such alternative configurations will now be described in reference to FIGS. 46–63.

Figure 46:
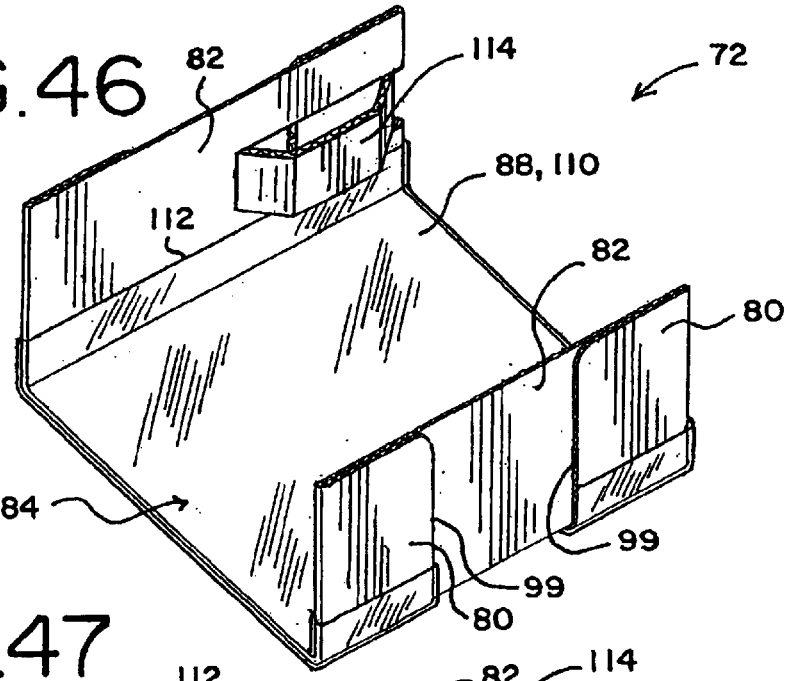
FIG. 46 shows a perspective view of a seventh retention-type suspension package embodying features of the present invention in a folded condition.
Figure 47:
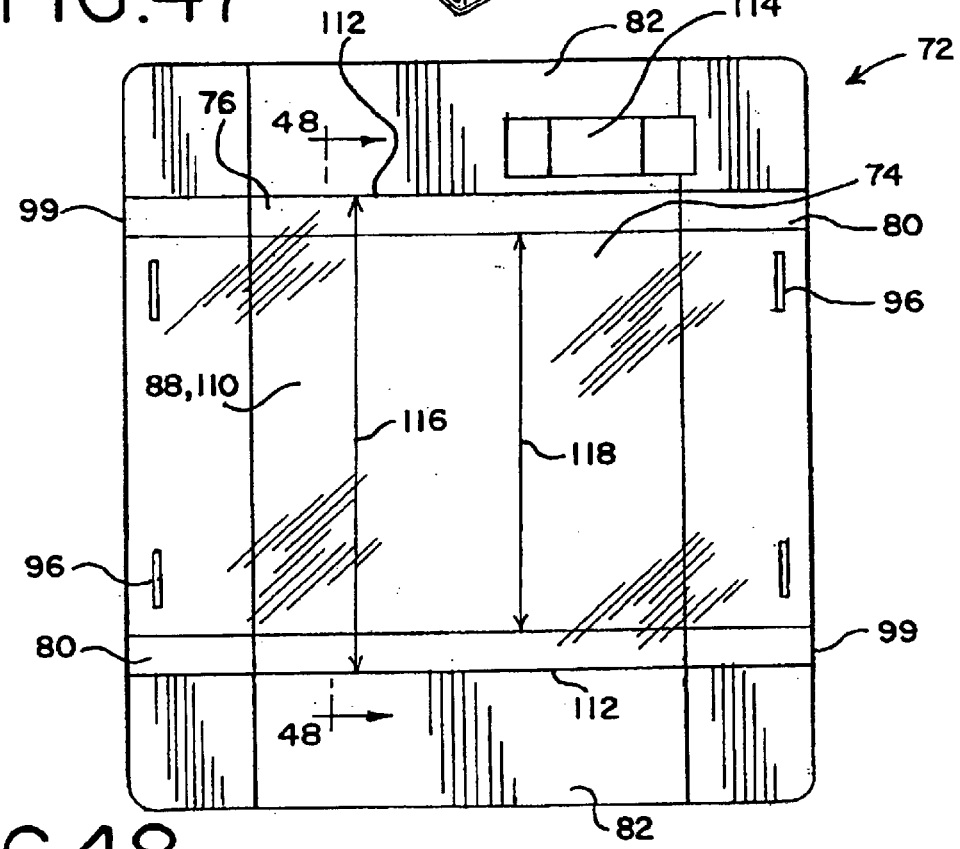
FIG. 47 shows a plan view from the top of the suspension package shown in FIG. 46 under ambient conditions.
Figure 48:
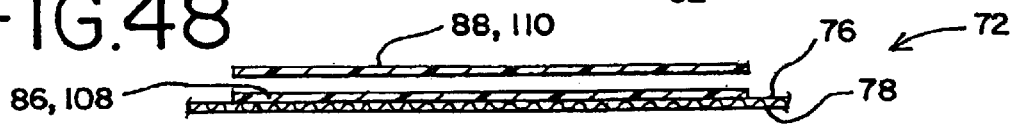
FIG. 48 shows a cross-sectional view of the suspension package shown in FIGS. 46 and 47 taken along the line 48—48.

A seventh series of presently preferred retention-type suspension packages embodying features of the present invention is shown in FIGS. 46–48. This series differs from the suspension packages shown in FIGS. 28–45 in that the elastomeric enclosure 84 corresponds to a pair of first and second film materials, 108 and 110, respectively. The first film material 108 is configured to contact the first face 76 of product-supporting platform 74, and to be interposed between the product-supporting platform 74 and a product inserted between the two film materials. The second film material 110 is configured to overlie the first film material 108. In such configurations, it is presently preferred that the second film material 110 be "looser" than the first film material 108 (e.g., be longer in length so as to provide space to accommodate a product inserted between the two film materials). The "looseness" of the first film material 108 provides slack when the suspension package 72 is in the folded position shown in FIG. 46. The degree of slack is determined based on the size and/or shape of the product to be packaged, with bulkier objects preferably corresponding to increased degrees of slack. In addition, it is presently preferred that the first film material 108 in contact with the product-supporting platform 74 have a length such that there is relatively little slack in the first film material 108.

It is presently preferred that the first and second film materials, 108 and 110, respectively, correspond to two physically separate layers with the second superimposed over the first. In this configuration, as best shown in FIGS. 47 and 48, a product may be inserted between the two films from either open side 112. Moreover, for presently preferred embodiments described herein in which the elastomeric enclosure corresponds to a pair of first and second film materials, it is presently preferred that at least a portion of first film material 108 be attached to at least a portion of second film material 110 on at least a portion of the ends thereof (i.e., the portions attached to end panels 80), such that the film materials will not flap open or apart but will retain a configuration in which second film material 110 substantially overlies first film material 108. Preferably, at least a portion of the ends of first and second film materials, 108 and 110, respectively, are attached near the outer edges 99 of end panels 80. This attachment may be provided by all manner of fastening mechanisms, including but not limited to staples 96 (as shown in FIG. 47), adhesives, sonic sealing, radiofrequency sealing, heat sealing, and the like, and combinations thereof, with sonic sealing being presently preferred.

As described above, it is presently preferred that the first and second film materials, 108 and 110, respectively, correspond to two physically separate layers. However, in alternative configurations (not shown), the first and second film materials, 108 and 110, respectively, are joined along at least one of their edges, provided there is an opening in at least one of the sides 112. As one example of such an alternative configuration, the first and second film materials, 108 and 110 respectively, may be provided by a single sheet of film having a length corresponding to a desired combined length of first film material 108 and second film materials 110, including any slack that is to be provided in the second film material 110 and/or the first film material 108. In this representative alternative configuration, a first end of the sheet of film may be fastened to one of the end panels 80 (e.g., near the outer edge 99 thereof and an intermediate portion of the sheet of film may be fastened to the other end panel 80 (e.g., near the outer edge 99 thereof. The sheet of film is then folded over onto itself near the intermediate portion and the second end of the sheet of film is fastened to the end panel 80 to which the first end of the sheet of film is fastened, such that the portion of the sheet of film between the first end and the intermediate portion corresponds to first film material 108, and the folded over portion corresponds to second film material 110. In this representative alternative configuration, both the first end of the sheet of film and the second end of the sheet of film may be fastened to the same end panel using a common fastener (e.g. one or more staples through both the first end and the second end of the sheet of film). Alternatively, both the first end of the sheet of film and the second end of the sheet of film may be fastened to each other (e.g., via sonic welding) and then fastened to the end panel (e.g., with an adhesive, staples, etc.).

In the suspension packages shown in FIGS. 46–48, and best shown by FIGS. 46 and 47, one of the side panels 82 includes a fold-out portion 114 intended to secure small and relatively unbreakable accessories that are to be included with a product (e.g., power cords, screws, product literature, etc.).

When the elastomeric enclosure 84 corresponds to first and second film materials, 108 and 110, respectively, as in the presently preferred embodiments shown in FIGS. 46–48, the first portion 86 of elastomeric enclosure 84 corresponds to the first film material 108, and the second portion 88, at least a portion of which is configured to overlie the first portion 86 corresponds to the second film material 110. The elastomeric enclosure 84, which preferably comprises a polymeric film, may include product retention regions, such as welded dots and/or knurled patterns formed by sonic welding, to further restrict movement of a product restrained therein.

The polymeric films forming first and second film materials, 108 and 110, respectively, may be attached to each of the two end panels 80 by any suitable fastener, including but not limited to staples, adhesives, tapes, stitches, and combinations thereof. Staples 96 and adhesives are presently preferred fasteners, which also may be optionally used to secure folded portions of the suspension package 72. Although the points of attachment of fasteners to the elastomeric enclosure 84 is not limited, it is preferred that the fasteners, for example staples 96, be introduced at opposite ends of elastomeric enclosure 84, more preferably at opposite points defining the furthest distance between the two ends of elastomeric enclosure 84. Depending on the length of elastomeric enclosure 84, the ends of elastomeric enclosure 84 may be fastened to end panels 80 on the sides adjacent to the first face 76 of product-supporting platform 74. Alternatively, for longer elastomeric enclosures 84, the ends thereof may be wrapped around end panels 80 and fastened thereto on the sides adjacent to the second face 78 of product-supporting platform 74. It is presently preferred that one or more fasteners (e.g., adhesives, staples 96, etc.) be introduced near an outer edge 99 of end panels 80 on the faces thereof that are adjacent to the first face 76 of product-supporting platform 74.

When the elastomeric enclosure 84 corresponds to first and second film materials, 108 and 110, respectively, as in the presently preferred embodiments shown in FIGS. 46–48, and when the film materials are open along one or both of sides 112, as further shown in FIGS. 46–48, it is presently preferred that the widths 116 of first and second film materials, 108 and 110, respectively, be at least as large as, and preferably larger than, the width 118 of the product-supporting platform 74. In such a configuration, damage caused by the partial or complete escape of a product from between the film materials is minimized or prevented. In alternative configurations (not shown), the widths 116 of first and second film materials, 108 and 110, respectively, are not the same. However, it is presently preferred that the width of the first film material 108 adjacent to the product-supporting platform 74 be substantially the same or larger than the width of the second film material 110.

Figure 49:
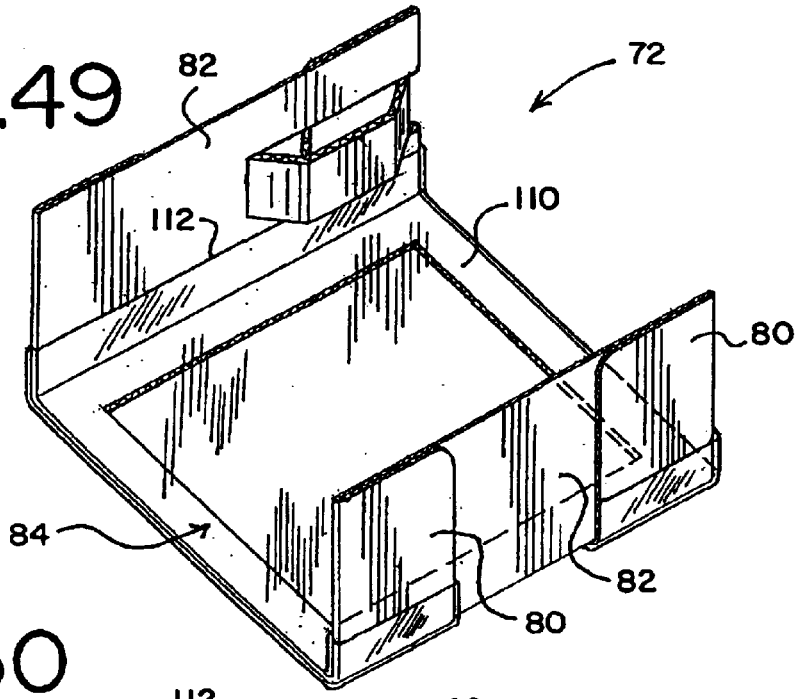
FIG. 49 shows a perspective view of an eighth retention-type suspension package embodying features of the present invention in a folded condition.
Figure 50:
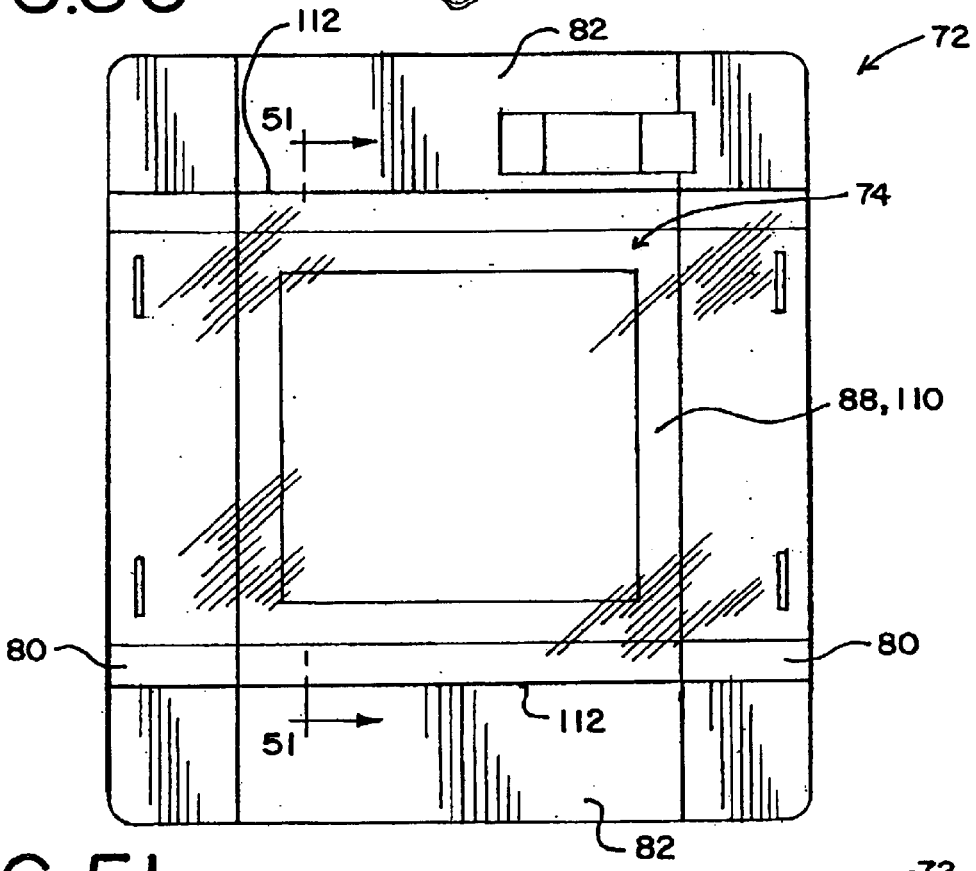
FIG. 50 shows a plan view from the top of the suspension package shown in FIG. 49 under ambient conditions.
Figure 51:
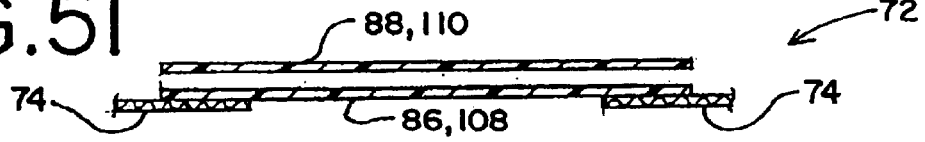
FIG. 51 shows a cross-sectional view of the suspension package shown in FIGS. 49 and 50 taken along the line 51—51.

An eighth series of presently preferred retention-type suspension packages embodying features of the present invention is shown in FIGS. 49–51. This series differs from the suspension packages shown in FIGS. 46–48 in that a portion of the product-supporting platform 74 has been removed to provide a square opening therein, such that all or a portion of a product suspended in the elastomeric enclosure 84, depicted in FIGS. 49–51 as a pair of first and second film materials, 108 and 110, respectively, for purposes of illustration, will not come to bear against the product-supporting platform 74 but rather will be suspended over the opening. Although the opening shown in FIGS. 49–51 has a square shape, alternative geometries may be employed. All manner of regular and irregular geometric shapes are contemplated for use in accordance with this opening, including but not limited to circular, square, triangular, rectangular, and substantially product-shaped holes.

Figures 52, 53, 54:
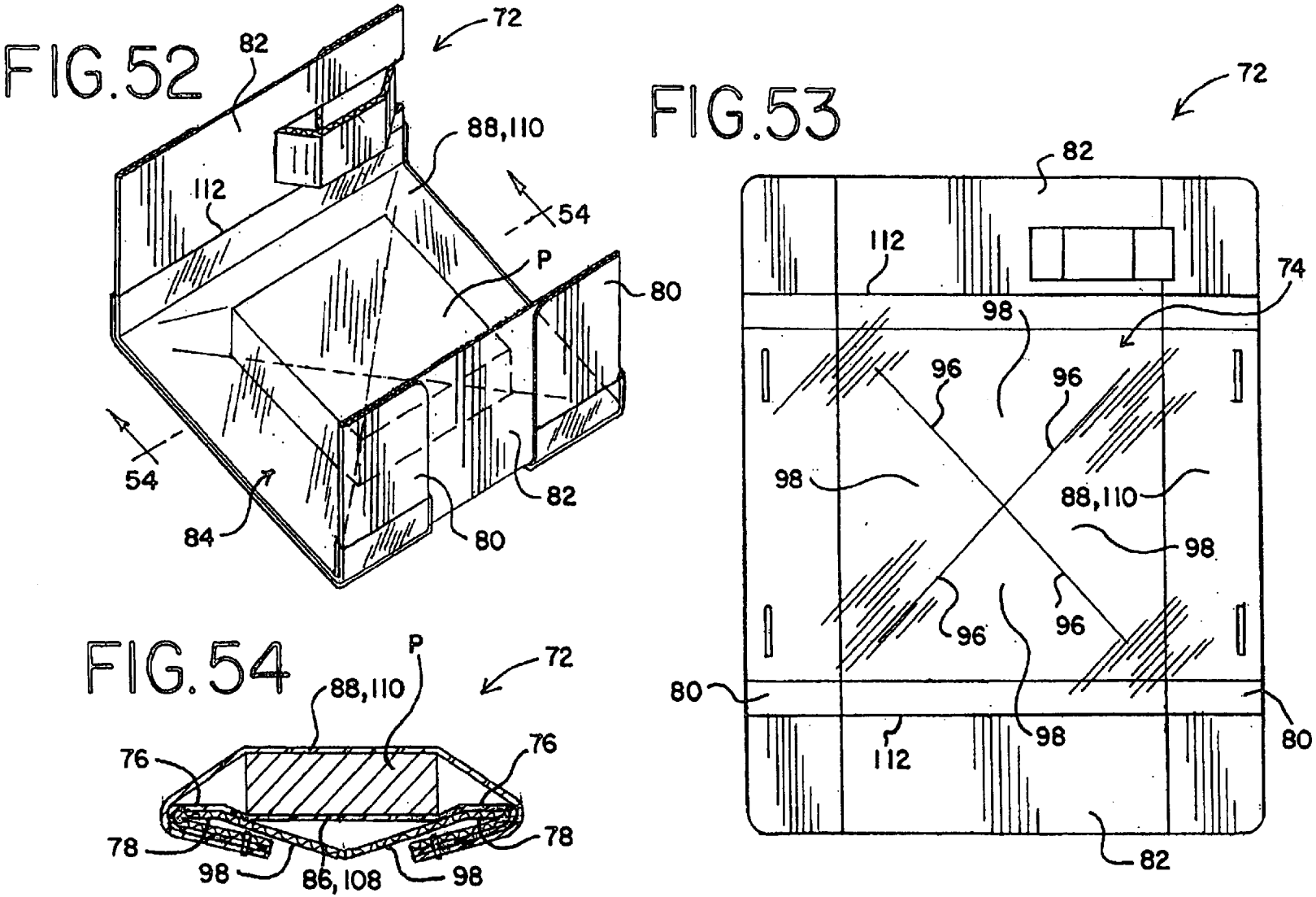
FIG. 52 shows a perspective view of a ninth retention-type suspension package embodying features of the present invention in a folded condition.
FIG. 53 shows a plan view from the top of the suspension package shown in FIG. 52 under ambient conditions.
FIG. 54 shows a cross-sectional view of the suspension package shown in FIGS. 52 and 53 taken along the line 54—54.

A ninth series of presently preferred retention-type suspension packages embodying features of the present invention is shown in FIGS. 52–54. This series differs from the suspension packages shown in FIGS. 46–51 in that the product-supporting platform 74 of suspension package 72 is perforated by a plurality of perforations 96 therein, which are configured to form a plurality of flaps 98. In the representative configuration shown in FIGS. 52–54, and best shown by FIG. 53, there are four perforations 96, which are arranged such that four V-shaped flaps 98 are formed thereby. The V-shaped flaps 98 are configured to bend downwards towards the second face 78 of product-supporting platform 74 under the weight of a product P, as best shown by FIG. 54. In addition, products of a certain shape may show a tendency to roll towards the center of the product-supporting platform 74.

Figure 56:
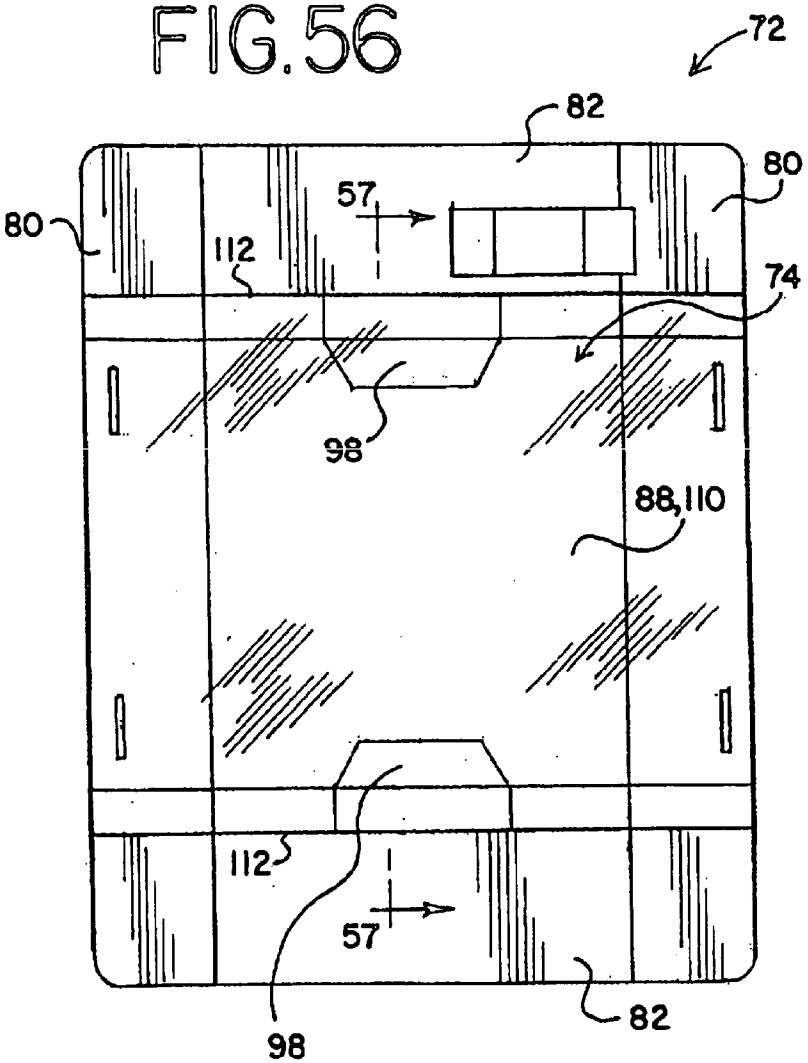
FIG. 56 shows a plan view from the top of the suspension package shown in FIG. 55 under ambient conditions.
Figure 55:
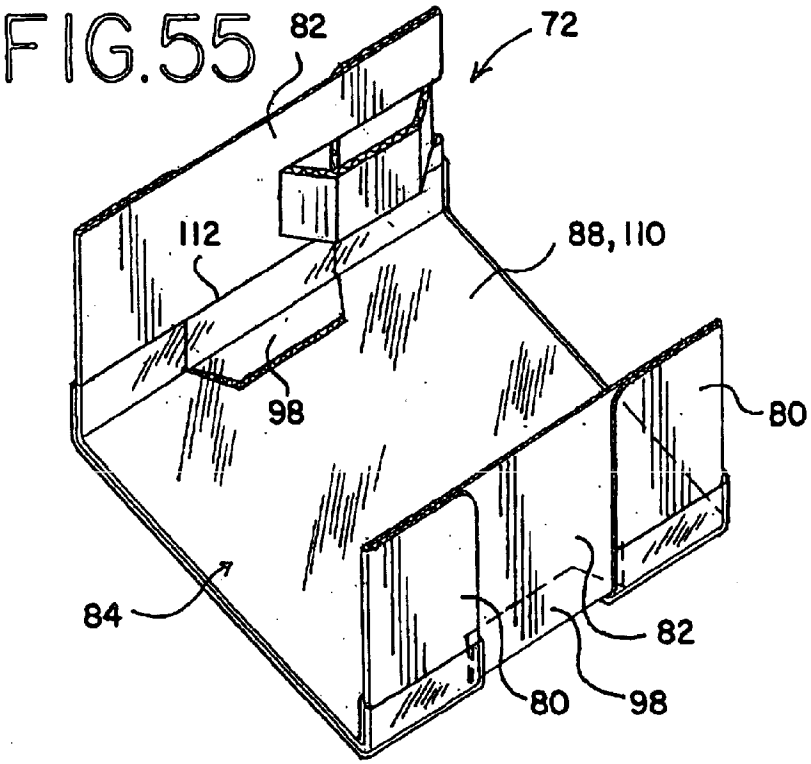
FIG. 55 shows a perspective view of a tenth retention-type suspension package embodying features of the present invention in a folded condition.
Figure 57:
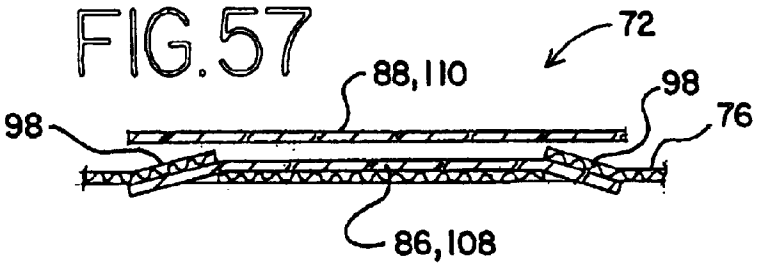
FIG. 57 shows a cross-sectional view of the suspension package shown in FIGS. 55 and 56 taken along the line 57—57.

A tenth series of presently preferred retention-type suspension packages embodying features of the present invention is shown in FIGS. 55–57. This series differs from the suspension packages shown in FIGS. 46–54 in that a portion of the product-supporting platform 74 has been perforated to form flaps 98, which are used to fasten the first portion 86 of the elastomeric enclosure 84, depicted in FIGS. 55–57 as a pair of first and second film materials, 108 and 110, respectively, for purposes of illustration, against the product-supporting platform 74, as best shown by FIG. 57. Such a configuration is desirable inasmuch as the flaps 98 hold the first film material 108 against the product-supporting platform 74, thereby facilitating grasping of the second film material 110 without simultaneous grasping of the first film material 108, and in turn facilitating product insertion between the two film materials.

Figure 58:
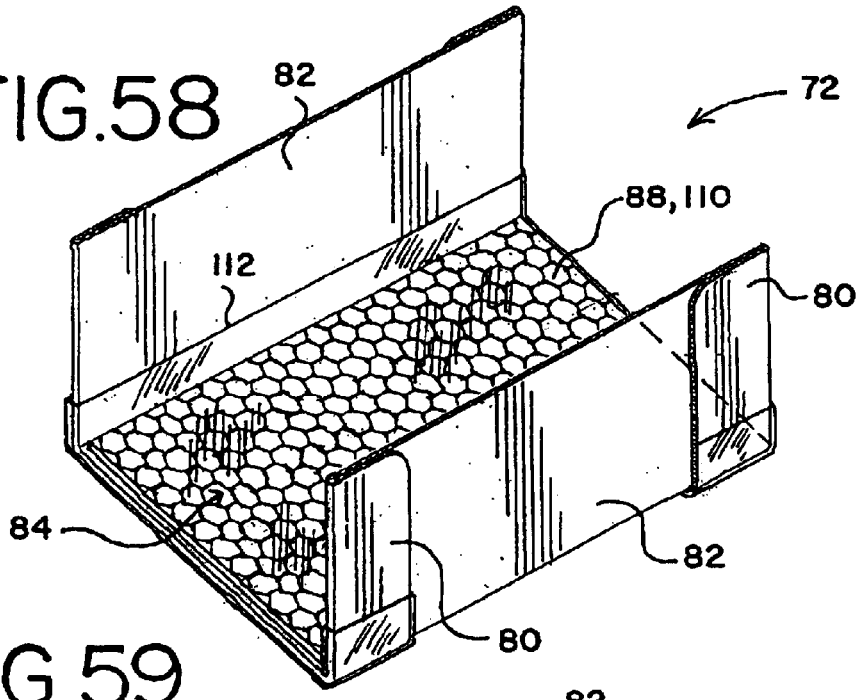
FIG. 58 shows a perspective view of an eleventh retention-type suspension package embodying features of the present invention in a folded condition.
Figure 59:
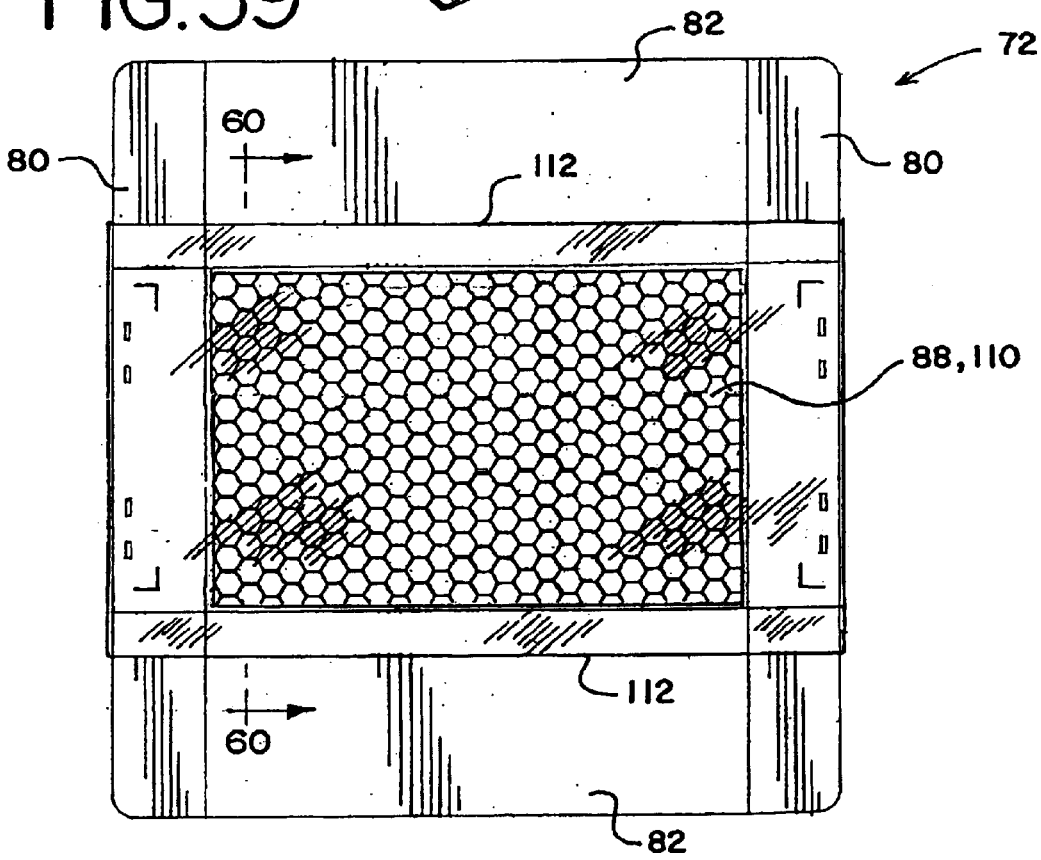
FIG. 59 shows a plan view from the top of the suspension package shown in FIG. 58 under ambient conditions.
Figure 60:
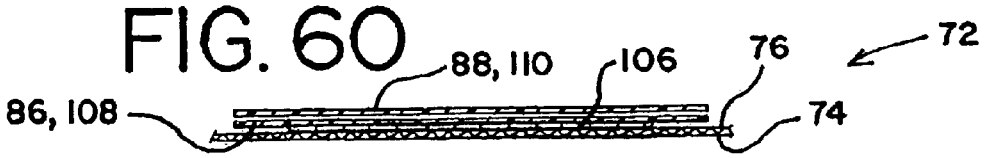
FIG. 60 shows a cross-sectional view of the suspension package shown in FIGS. 58 and 59 taken along the line 60—60.

An eleventh series of presently preferred retention-type suspension packages embodying features of the present invention is shown in FIGS. 58–60. This series differs from the suspension packages shown in FIGS. 46–57 in that a cushioning layer 106 is attached to the first face 76 of the product-supporting platform 74. The cushioning layer 106 is interposed between the product-supporting platform 74 and the first portion 86 of the elastomeric enclosure 84, depicted in FIGS. 58–60 as a pair of first and second film materials, 108 and 110, respectively, for purposes of illustration. Such a configuration is desirable inasmuch as cushioning layer 106 provides additional protection against damage to a product contained between first and second film materials, 108 and 110, respectively. As described above, all manner of shapes, sizes, and materials are contemplated for use in accordance with cushioning layer 106. As further described above, presently preferred materials for cushioning layer 106 include but are not limited to bubble wrap, shown in FIGS. 58–60 for purposes of illustration. It should be noted that in the suspension packages shown in FIGS. 58–60, the first film material 108 remains interposed between a product contained between first and second film materials, 108 and 110, respectively, and both the cushioning layer 106 and the product-supporting platform 74.

Figure 62:
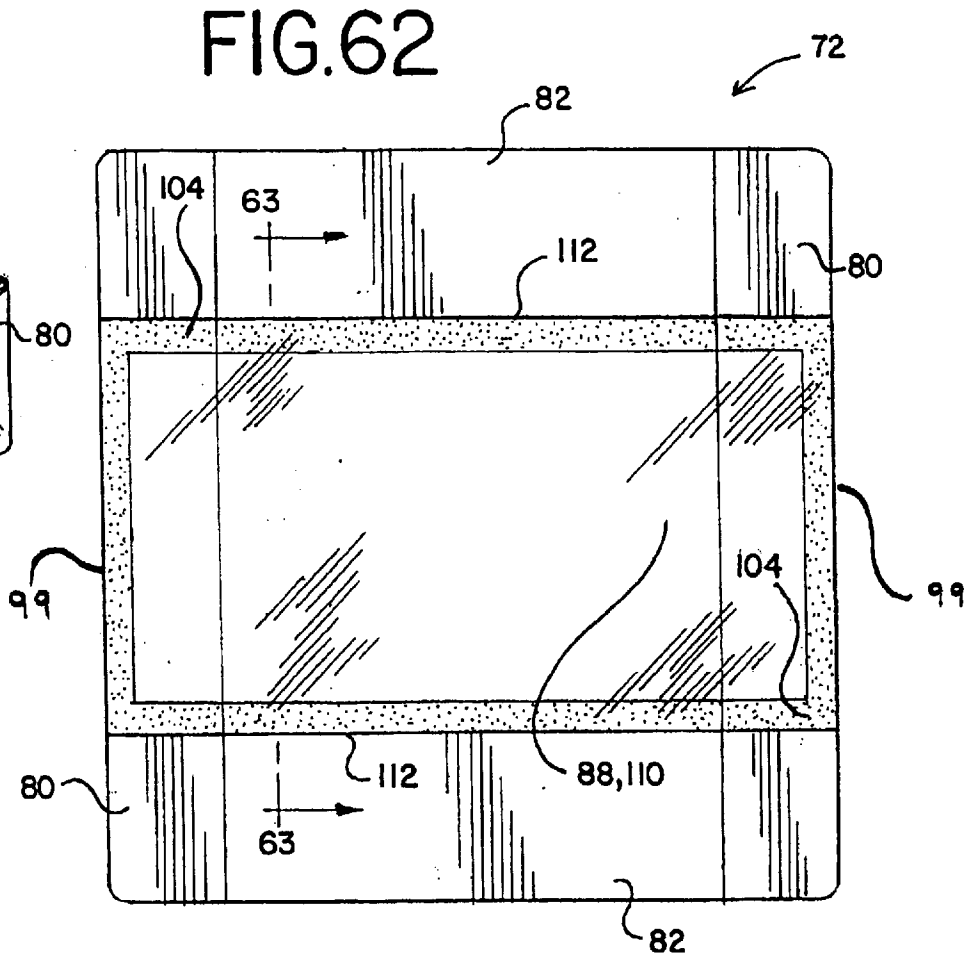
FIG. 62 shows a plan view from the top of the suspension package shown in FIG. 61 under ambient conditions.
Figure 61:
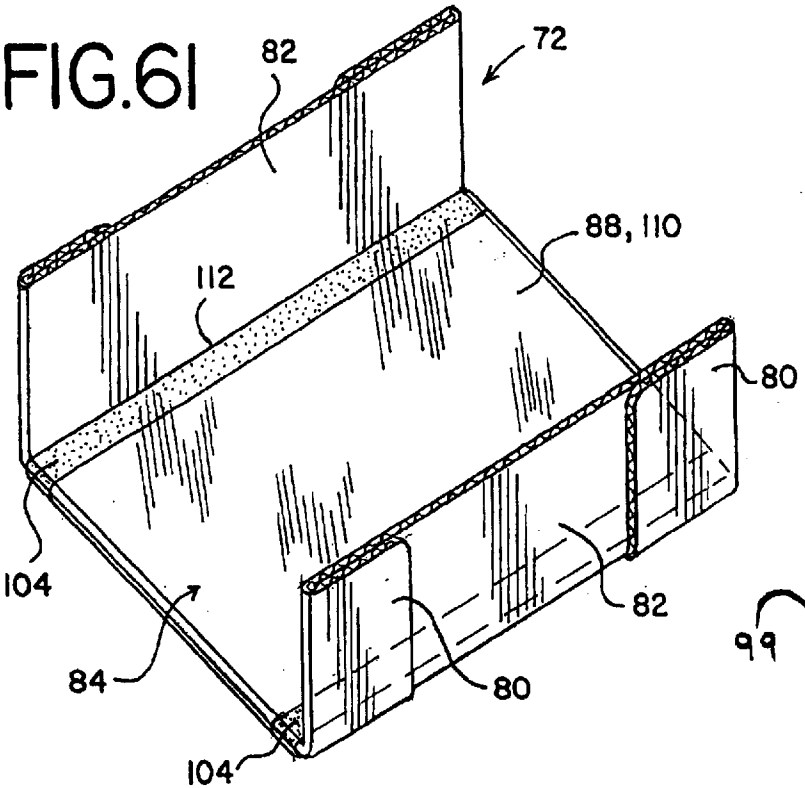
FIG. 61 shows a perspective view of a twelfth retention-type suspension package embodying features of the present invention in a folded condition.
Figure 63:
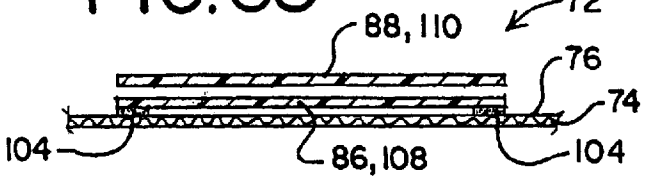
FIG. 63 shows a cross-sectional view of the suspension package shown in FIGS. 61 and 62 taken along the line 63—63.

A twelfth series of presently preferred retention-type suspension packages embodying features of the present invention is shown in FIGS. 61–63. This series differs from the suspension packages shown in FIGS. 46–60 in that the periphery of a bottom surface of the elastomeric enclosure 84, depicted in FIGS. 61–63 as a pair of first and second film materials, 108 and 110, respectively, for purposes of illustration, is adhered with an adhesive 104 to the first face 76 of the product-supporting platform 74 and to the end panels 80. In an alternative configuration (not shown), substantially the entirety of this bottom surface is adhered to the first face 76 and/or to the end panels 80. In the representative configuration shown in FIGS. 61–63, and best shown by FIG. 62, a strip of adhesive 104 affixes the periphery of the first film material 108 to the product-supporting platform 74 and to end panels 80. Such a configuration is desirable inasmuch as it facilitates grasping of the second film material 110 without simultaneous grasping of the first film material 108, thereby facilitating product insertion between the two film materials. All manner of adhesives and alternative attachment mechanisms (e.g., stapling, sewing, and the like) are contemplated for attaching a bottom surface of the elastomeric enclosure to the product-supporting platform, with adhesives being presently preferred agents for use in accordance with the present invention. The adhesive sold under the name FULLER HL-2201-XZP is a presently preferred adhesive. Moreover, as described above, it is presently preferred that at least a portion of first film material 108 be attached to at least a portion of second film material 110 on at least a portion of the ends thereof (i.e., the portions attached to end panels 80). As further described above, it is presently preferred that this attachment be near the outer edges 99 of end panels 80 and that it be achieved using sonic welding.

In the seventh through twelfth series of presently preferred retention-type suspension packages described above, the elastomeric enclosures 84 correspond to pairs of first and second film materials, 108 and 110, respectively, which are presently preferred configurations. However, in alternative configurations, the elastomeric enclosures 84 correspond to a bellows-fold hammock. Such alternative configurations will now be described in reference to FIGS. 64–66.

Figure 64:
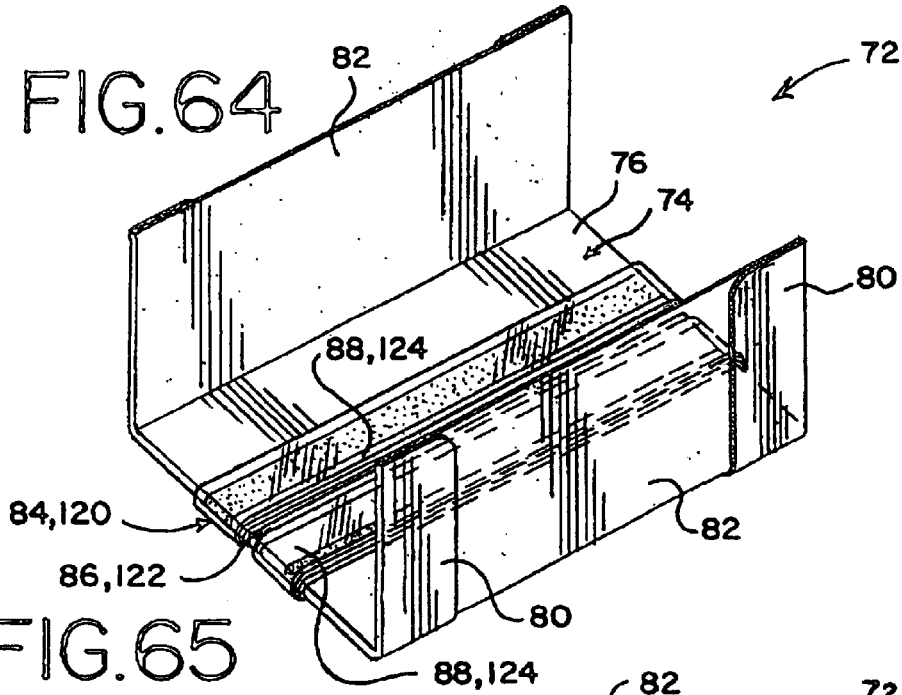
FIG. 64 shows a perspective view of a thirteenth retention-type suspension package embodying features of the present invention in a folded condition.
Figure 65:
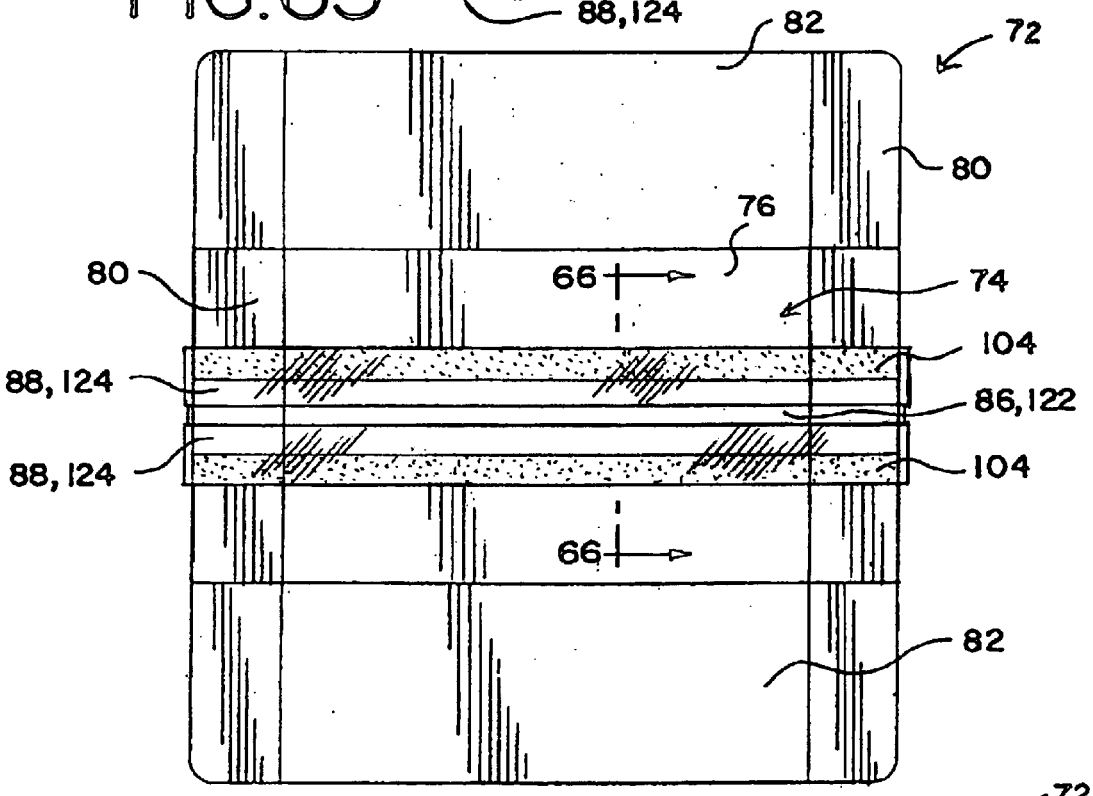
FIG. 65 shows a plan view from the top of the suspension package shown in FIG. 64 under ambient conditions.
Figure 66:
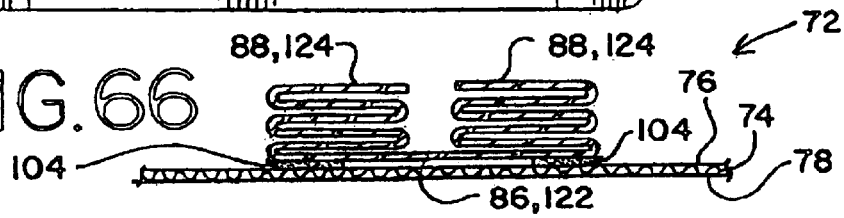
FIG. 66 shows a cross-sectional view of the suspension package shown in FIGS. 64 and 65 taken along the line 66—66.

A thirteenth series of presently preferred retention-type suspension packages embodying features of the present invention is shown in FIGS. 64–66. This series differs from the suspension packages shown in FIGS. 28–63 in that the elastomeric enclosure 84 corresponds to a bellows-fold hammock 120. The bellows-fold hammock 120, best shown by FIG. 66, is configured for expansion when a product is placed therein, and for contraction in its ambient, unloaded condition. When the elastomeric enclosure 84 corresponds to a bellows-fold hammock 120, as in the presently preferred embodiments shown in FIGS. 64–66, the first portion 86 of elastomeric enclosure 84 corresponds to the lower portion 122 of bellows-fold hammock 120, and the second portion 88, at least a portion of which is configured to overlie the first portion 86 corresponds to the upper portions 124 of bellows-fold hammock 120. The elastomeric enclosure 84, which preferably comprises a polymeric film, may include product retention regions, such as welded dots and/or knurled patterns formed by sonic welding, to further restrict movement of a product restrained therein. As described above in connection with C-fold hammocks, it should be noted that the degree of separation between the edges of the two upper portions 124 (and, in turn, the size of the opening defining the product insertion and removal region) is not limited. In certain configurations, the two upper portions 124 may be separated by a distance (e.g., as shown in FIGS. 64–66), in contact along an edge, or completely overlapping in their ambient empty or unloaded conditions. Preferably, the width of the two upper portions 124 is sufficiently large, such that the interior region of hammock 120 is capable of substantially enclosing a product (e.g., enveloping the product on at least a portion of each of its sides).

In the presently preferred embodiments depicted in FIGS. 64–66, the lengthwise portions of the bottom surface of the elastomeric enclosure 84 is adhered with an adhesive 104 to the first face 76 of the product-supporting platform 74 and to the end panels 80. In alternative configurations (not shown), the periphery of this bottom surface or substantially the entirety of this bottom surface is adhered to the first face 76 and/or to end panels 80. In the representative configuration shown in FIGS. 64–66, and best shown by FIG. 65, a strip of adhesive 104 affixes the lengthwise portions of the bottom surface of the bellows-fold hammock 120 to the product-supporting platform 74 and to end panels 80. Such a configuration is desirable inasmuch as it facilitates grasping of the upper portions 124 of bellows-fold hammock 120 without simultaneous grasping of the lower portion 122, thereby facilitating product insertion into hammock 120. Preferably, the ends of the bellows-fold hammock 120 are wrapped around end panels 80 and fastened thereto (e.g., with an adhesive) on the sides adjacent to the second face 78 of product-supporting platform 74. All manner of adhesives and alternative attachment mechanisms (e.g., stapling, sewing, and the like) are contemplated for attaching a bottom surface of the elastomeric enclosure to the product-supporting platform, with adhesives being presently preferred agents for use in accordance with the present invention. The adhesive sold under the name FULLER HL-2201-XZP is a presently preferred adhesive.

In the thirteenth series of presently preferred retention-type suspension packages described above, the elastomeric enclosures 84 correspond to a bellows-fold hammock 120, which is a presently preferred configuration. However, in alternative configurations, the elastomeric enclosures 84 include an inverted C-fold hammock configured to be wrapped over a first portion of the elastomeric enclosure 84 such that a product positioned on the first portion will be substantially covered by the inverted C-fold hammock. Such alternative configurations will now be described in reference to FIGS. 67–70.

Figures 67, 68, 69, 70:
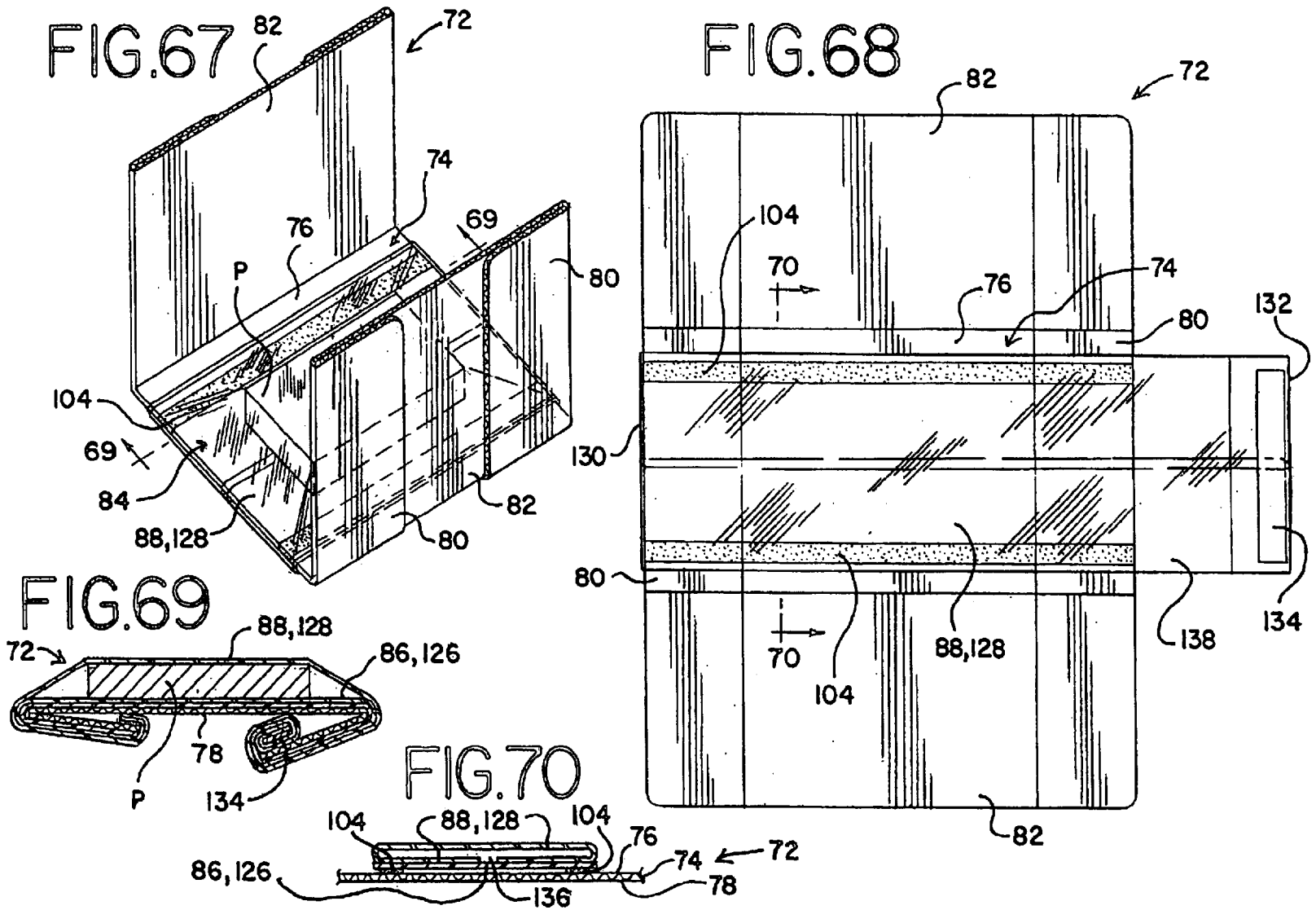
FIG. 67 shows a perspective view of a fourteenth retention-type suspension package embodying features of the present invention in a folded condition.
FIG. 68 shows a plan view from the top of the suspension package shown in FIG. 67 under ambient conditions.
FIG. 69 shows a cross-sectional view of the suspension package shown in FIGS. 67 and 68 taken along the line 69—69.
FIG. 70 shows a cross-sectional view of the suspension package shown in FIGS. 67–69 taken along the line 70—70.

A fourteenth series of presently preferred retention-type suspension packages embodying features of the present invention is shown in FIGS. 67–70. This series differs from the suspension packages shown in FIGS. 28–66 in that the elastomeric enclosure 84 includes a first portion 86 at least a portion of which is attached (e.g., with an adhesive) to the first face 76 of the product-supporting platform 74 and to the end panels 80, and an adjustable second portion 88 that corresponds to an inverted C-fold hammock 128. In the representative configuration shown in FIGS. 67–70, the first portion 86 of elastomeric enclosure 84 corresponds to a film material 126 attached along its length to the first face 76 of product-supporting platform 74 and to end panels 80 with an adhesive 104. The inverted C-fold hammock 128 includes a first end 130 attached to one of the two end panels 80 (e.g., with an adhesive) and a second end 132 that is free and unattached. The first end 130 is wrapped around one of end panels 80 and fastened thereto (e.g., with an adhesive) on the side adjacent to the second face 78 of product-supporting platform 74. As shown in FIG. 68, the second portion 88 of elastomeric enclosure 84, which is configured to be wrapped over the first portion 86, is longer than the first portion 86 and preferably includes a handle 134 (e.g., a substantially flat, rigid member made, for example, from a plastic material) to facilitate adjustment (e.g., shortening) of the free second end 132.

In the representative configuration shown in FIGS. 67–70, a product P is placed on film material 126 with the inverted C-fold hammock 128 initially positioned out of the way (e.g., off to the side of the end panel 80 to which first end 130 is attached). When the product P is in place, the inverted C-fold hammock 128 is pulled over product P and film material 126 using handle 134, such that at least a portion of the product P is positioned in an opening 136 in inverted C-fold hammock 128. As best shown by FIG. 70, the opening 136 in inverted C-fold hammock 128 faces film material 126 and product-supporting platform 74 when the inverted C-fold hammock 128 is positioned over the first film material 126. As shown in FIG. 68, the second end 132 of inverted C-fold hammock 128 initially includes an excess portion 138. This excess portion 138 may be wound around the handle 134 to remove excess slack in inverted C-fold hammock 128, thereby tightening inverted C-fold hammock 128 over product P. The handle 134 and the excess portion 138 wound around it are then positioned behind the end panel 80 closest thereto on the side of the end panel 80 adjacent to the second face 78 of product-supporting platform 74. Thus, when the end panel 80 nearest second end 132 is pivoted to contact the second face 78 of product-supporting platform 74, as shown in FIG. 67, the handle 134 and the excess portion 138 are held between the second face 78 and the end panel 80, as best shown by FIG. 69.

In the representative configuration shown in FIGS. 67–70, the first portion 86 of elastomeric enclosure 84 corresponds to a film material 126. However, in alternative configurations, the first portion 86 corresponds to a C-fold hammock, the opening of which is configured to face the opening 136 of the inverted C-fold hammock 128 when the latter is positioned to face the product-supporting platform 74. As one example of such an alternative configuration, the C-fold hammock corresponding to the first portion 86 and the inverted C-fold hammock corresponding to the second portion 88 may both be provided by a contiguous piece of film having a C-shaped cross-section. In this alternative configuration, the portion of film corresponding to the C-fold hammock is fastened to the first face 76 of product-supporting platform 74 and to end panels 80 with an adhesive 104. The remainder of the film (i.e., the unattached portion configured to be wrapped over the C-fold hammock) corresponds to the inverted C-fold hammock.

The above-described fourteenth series of presently preferred retention-type suspension packages may be particularly desirable for use in protecting stacks of products, such as books, from being damaged during transit.

Suspension systems embodying features of the present invention include any cushioning-type or retention-type suspension package of a type described herein and an outer container for enclosing the suspension package. By way of example, a first suspension system embodying features of the present invention, shown in FIGS. 7, 8, and 9, includes (a) a cushioning-type suspension package from the above-described presently preferred first series (e.g., FIGS. 1–6), and (b) an outer container 44 for enclosing the suspension package. Similarly, a second suspension system embodying features of the present invention, shown in FIGS. 16 and 17, includes (a) a cushioning-type suspension package from the above-described presently preferred second series (e.g., FIGS. 10–15), and (b) an outer container 44 for enclosing the suspension package. Preferably, the outer container 44 contains a plurality of fixed panels 46 and at least one pivotally connected flap 48 defining an insertion and removal region. Preferably, the outer container 44 is a top-loading box.

For suspension systems that include a cushioning-type suspension package of a type described herein, it is presently preferred that the outer container 44 be dimensioned such that when the elastomeric enclosure 14 of the suspension package 2 is tensioned and the suspension package 2 is enclosed by the outer container 44 under activated conditions, the side panels 12 of the suspension package 2 are prevented from pivoting towards a configuration substantially coplanar with the product-supporting platform (i.e., are prevented from returning to the ambient condition depicted in FIGS. 5 and 14). Moreover, it is presently preferred that the outer container 44 be dimensioned such that the side panels 12 are held in a configuration substantially perpendicular to the product-supporting platform.

Figure 16:
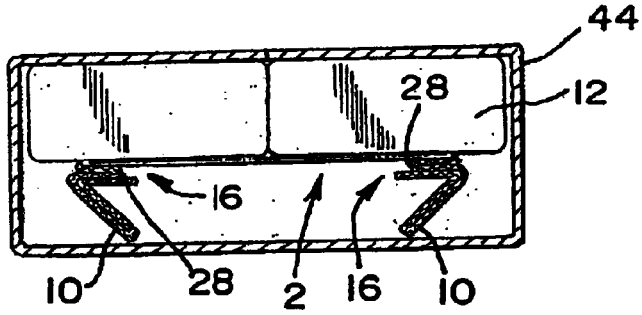
FIG. 16 shows a cross-sectional side view of a second cushioning-type suspension system embodying features of the present invention under activated conditions.

In addition, for suspension systems that include a cushioning-type suspension package of a type described herein, presently preferred dimensions of the outer container 44 are such that the activated height of the suspension package 2 enclosed therein (i.e., the height of a product-containing suspension package 2 measured from the bottom edge of the end panels 10 to the top edge of side panels 12) is slightly greater (i.e., less than about ten percent) than an internal height of the outer container 44 when the latter is open. Furthermore, it is preferred that the outer container 44 be dimensioned such that the activated height of the suspension package 2 enclosed therein is substantially equal to the internal height of the outer container 44 when the latter is closed, as shown in FIGS. 8 and 16. Thus, a pressure is exerted against at least one interior surface of the closed outer container 44 by the spring-cushioning action of the activated suspension package 2 enclosed therein.

Figure 17:
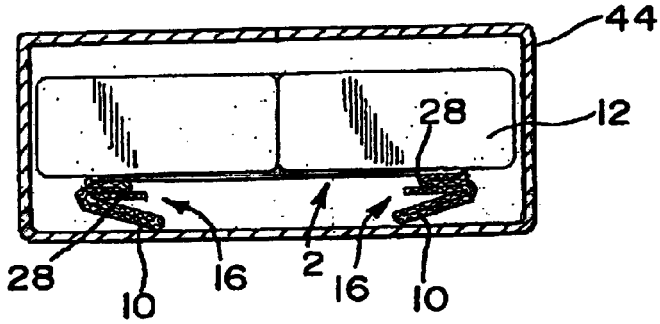
FIG. 17 shows a cross-sectional side view of the suspension system shown in FIG. 16 under bottom-out conditions.

If a suspension system embodying features of the present invention including a cushioning-type suspension package of a type described herein is subjected to an excessive bottom drop force, a point of maximum compression of the suspension package 2 within the outer container 44 may result, as shown in FIGS. 9 and 17. Under such bottom out conditions, the product has an increased susceptibility to damage. Thus, it is preferred that the degree of spring-cushioning effect that is provided by the elastomeric film under activated conditions be sufficient to prevent or at least significantly reduce the frequency of bottom out events.

In general, the dimensions of the outer container 44 are selected in view of the packaging requirements for a specific product (e.g., amount of deflection space required to protect a product, degree of elasticity of polymeric film, requisite degree of spring-cushioning effect needed to protect against bottom drops, etc.).

Figure 18:
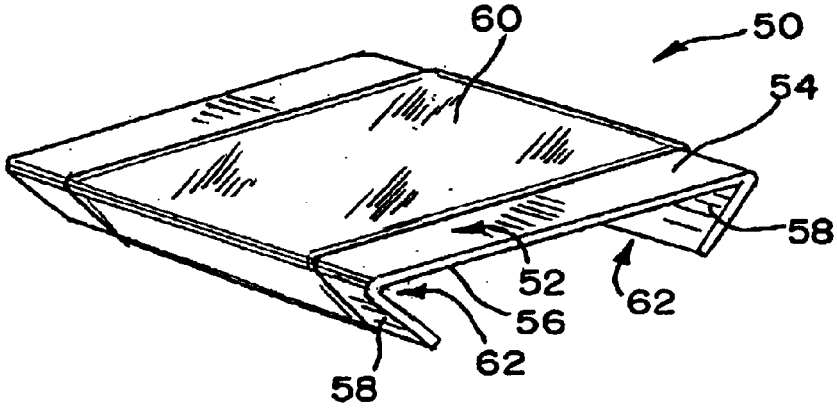
FIG. 18 shows a perspective view of a cushioning panel embodying features of the present invention.

A cushioning panel 50 embodying features of the present invention is shown in FIG. 18 and includes (a) a platform 52 having first and second opposed faces, 54 and 56, respectively; (b) two end panels 58, each pivotally connected to a respective end of the platform 52; and (c) an elastomeric member 60 mounted between the two end panels 58 and extending over the first face 54 of the platform 52. The end panels 58 may be pivoted towards the second face 56 of the platform 52, thereby stretching the elastomeric member 60. Acute angles 62 may be formed between the second face 56 of the platform 52 and each of the end panels 58, such that a biasing force acting to restore the end panels 58 to their ambient positions is established.

Preferably, the elastomeric member 60 is slightly (i.e., less than about ten percent) shorter than the distance between the ends of the end panels 58, which may be multi-folded. When the hinged end panels 58 are rotated towards the second face 56 of the platform 52, an outward tension is exerted by the elastomeric member 60, which biases the end panels 58 towards their ambient positions. Thus, when cushioning panels 50 embodying features of the present invention are placed in spatially restricted regions that prevent the end panels 58 from returning to their ambient positions, the cushioning panels 50 will function as spring-like devices when energy and/or forces are imparted thereto. For example, activated cushioning panels 50 positioned around a product within an outer container will act as shock absorbers by deflecting and then recovering in response to a force, thus attenuating the effects of potentially damaging external shocks. Cushioning panels 50 embodying features of the present invention may be used as the sole form of product protection, or in conjunction with one or more other protective systems.

Elastomeric members 60 for use in accordance with cushioning panels 50 embodying features of the present invention may be formed from any suitable elastomeric material, including but not limited to polymeric films, rubber, spandex cloth, and the like. Polymeric films such as polyurethane and polyethylene, such as may be used to form the elastomeric enclosures described above, are preferred materials at present, with polyurethane being especially preferred. All manner of geometries, widths, thicknesses, and the like are contemplated for the elastomeric members 60 embodying features of the present invention.

Cushioning-type and retention-type suspension packages embodying features of the present invention, as well as cushioning panels embodying features of the present invention, may be formed from any suitable material, including but not limited to paperboard, corrugated paperboard, plastics, fiberboard, metals, and the like, and combinations thereof. Corrugated paperboard (e.g., 275 pound single wall, kraft, C-flute board, 200 pound double wall, 275 or 300 pound double wall, kraft, B/C-flute board, etc.) is a presently preferred material. Preferably, all portions of suspension packages and cushioning panels embodying features of the present invention, except for the elastomeric enclosure, are formed from a single sheet of material. For example, each of the two end panels and the two side panels of a cushioning-type suspension package may be formed from a single sheet of corrugated paperboard that is simply folded along designated fold, crease, or score lines to provide the desired design of suspension package. Such an assembly process minimizes cost and simplifies fabrication. However, alternative embodiments are contemplated in which various pieces of the suspension package or cushioning panel are fabricated separately and then assembled to provide a completed suspension package.

Preferred characteristics of elastomeric enclosures and elastomeric members embodying features of the present invention, and particularly of those used in the cushioning-type suspension packages and cushioning panels described above, are that they (a) be stretchable so as to absorb energy and/or forces imparted during drops, and (b) exhibit a tendency to return to their original configurations (i.e., have "memory"). Accordingly, elastomeric enclosures may be formed from any suitable elastomeric material, including but not limited to polymeric films, spandex cloths, and the like. Polymeric films such as polyurethane and polyethylene are especially preferred materials at present. Polyurethane is an especially preferred polymeric film inasmuch as it exhibits both good stretch and good recovery characteristics. Polyethylene, which exhibits good stretch but not as good recovery, is still a suitable polymeric film in certain applications. In accordance with certain embodiments of the present invention, increased protection may be afforded to particularly sensitive products by using a film capable of more elastic deformation than might be required for less sensitive products in combination with an outer container that is larger than might be required for less sensitive products.

The lengths of the elastomeric enclosures used in accordance with the above-described cushioning-type and retention-type suspension packages may be varied. However, it is presently preferred that these lengths be approximately at least as long as the combined lengths of the product-supporting platform and the two end panels on which the elastomeric enclosure is mounted. In configurations in which the length of the elastomeric enclosure is approximately equal to the combined length of the product-supporting platform and the two end panels, the ends of the elastomeric enclosure may be fastened (e.g., with adhesives and/or staples) to the faces of the end panels that are adjacent to the first face of the product-supporting platform, preferably near an outer edge thereof (e.g., as shown in FIG. 54). In configurations in which the length of the elastomeric enclosure exceeds the combined length of the product-supporting platform and the two end panels, one or both ends of the elastomeric enclosure may be wrapped around the end panels and fastened (e.g., with adhesives and/or staples) to the faces of the end panels that are adjacent to the second face of the product-supporting platform, preferably near an outer edge thereof (e.g., as shown in FIGS. 21 and 24). Analogous comments apply to the elastomeric members used in accordance with the above-described cushioning panels.

Figure 71:
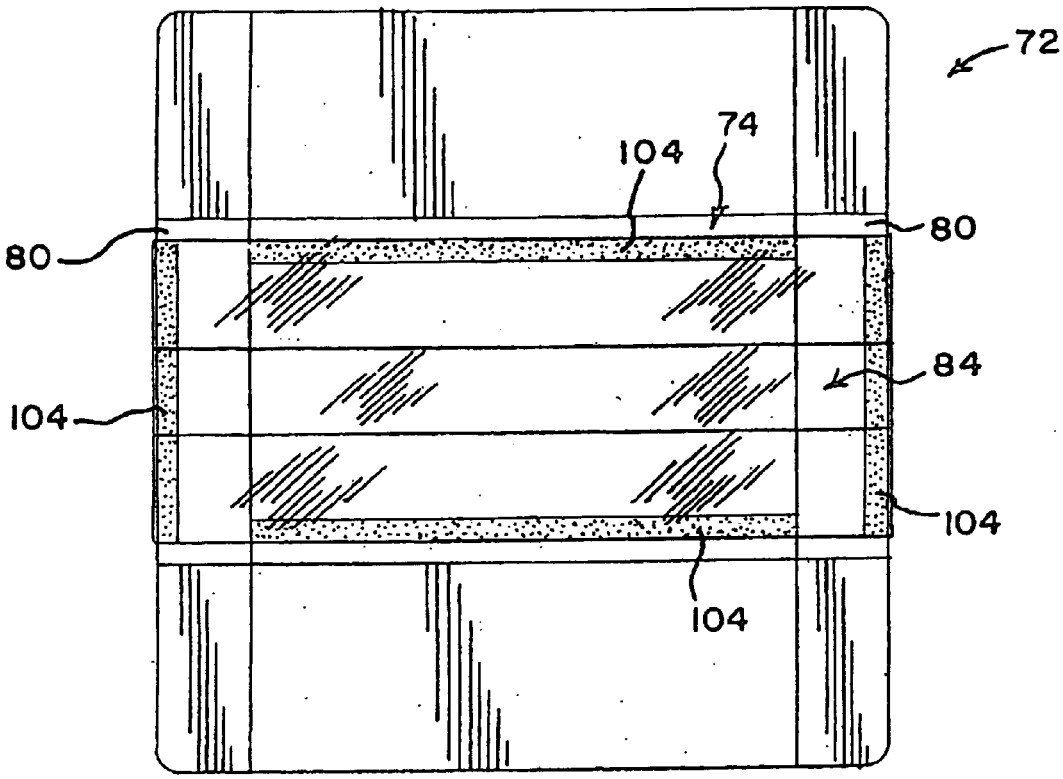
FIG. 71 shows a plan view from the top of a representative modification to the retention-type suspension package shown in FIG. 41.

Moreover, the manner in which elastomeric enclosures in accordance with the present invention are fastened to the end panels and/or product-supporting platforms of the above-described cushioning-type and retention-type suspension packages may also be varied. It should be noted that while several of the drawing figures depict staples as the only fastening mechanism for fastening of the elastomeric enclosures, other mechanisms, which may be used instead of or in addition to staples, may also be employed, including but not limited to adhesives. In addition, for drawing figures that depict adhesives as the fastening mechanism, it is to be understood that alternative gluing patterns to the ones shown may also be employed. By way of illustration, FIG. 41 shows a first presently preferred gluing pattern for a retention-type suspension package embodying features of the present invention in which an adhesive 104 affixes the lengthwise portions of a bottom surface of elastomeric enclosure 84 to the product-supporting platform 74 and to the end panels 80. In a presently preferred modification for use with elastomeric enclosures 84 that are longer than the combined length of the product-supporting platform 74 and the two end panels 80, the ends of the elastomeric enclosure 84 may be wrapped around the end panels 80 and adhered, on substantially the entirety thereof, to the faces of end panels 80 adjacent to the second face 78 of product-supporting platform 74. Furthermore, FIG. 71 shows a presently preferred alternative gluing pattern that may also be used, wherein an adhesive 104 affixes lengthwise portions of elastomeric enclosure 84 to the product-supporting platform 74 and widthwise portions of elastomeric enclosure 84 to the end panels 80. As will be readily understood by those of ordinary skill in the art, all manner of alternative gluing patterns may likewise be employed.

A first series of methods for packaging products in accordance with the present invention includes (a) placing a product in any of the suspension packages embodying features of the present invention described hereinabove; (b) tensioning the elastomeric enclosure of the suspension package, thereby substantially immobilizing the product; and (c) placing the suspension package in an outer container that is dimensioned such that the side panels of the suspension package are held in a configuration substantially perpendicular to the product-supporting platform.

A second series of methods for packaging products in accordance with the present invention includes (a) placing a product in a container having a plurality of walls; (b) tensioning a cushioning panel embodying features of the present invention; and (c) placing at least one tensioned cushioning panel between the product and at least one of the plurality of walls, such that the first face of the platform is adjacent to the product. Preferably, the container is dimensioned such that the end panels of the cushioning panel are prevented from returning to ambient positions.

The foregoing detailed description and accompanying drawings have been provided by way of explanation and illustration, and are not intended to limit the scope of the appended claims. Many variations in the presently preferred embodiments illustrated herein will be obvious to one of ordinary skill in the art (e.g., alternative shapes and relative dimensions of the suspension packages, elastomeric enclosures, etc.), and remain within the scope of the appended claims and their equivalents.

What is claimed is:

1. A suspension package comprising:

a product-supporting platform having first and second opposed faces;

two end panels, each pivotally connected to a respective end of the product-supporting platform;

two reinforcing flaps, each pivotally connected to an inner edge of the end panels, wherein the reinforcing flaps are configured to contact the second face of the product-supporting platform;

two side panels, each pivotally connected to a respective side of the product-supporting platform; and an elastomeric enclosure mounted between the two end panels and extending over the first face of the product-supporting platform; wherein the elastomeric enclosure is selected from the group consisting of a C-fold hammock, an inverted C-fold hammock, a bellows-fold hammock, a pair of first and second film materials, and combinations thereof;

the two side panels are configured to pivot towards the first face of the product-supporting platform and to be configured substantially perpendicular thereto; and the two end panels are configured to pivot between an un-tensioned state and a tensioned state, wherein in the tensioned state, acute angles are configured to form between the second face of the product-supporting platform and each of the end panels, and wherein the end panels are configured to provide a spring action against a surface in contact therewith.

2. The invention of claim 1 wherein the acute angles are not greater than fifty degrees.

3. The invention of claim 1 wherein each of the two end panels and the two side panels is connected to the product-supporting platform along a score line.

4. The invention of claim 1 wherein the product-supporting platform, the two end panels, and the two side panels are formed from a single sheet of material.

5. The invention of claim 4 wherein the material is selected from the group consisting of paperboard, corrugated paperboard, plastics, and fiberboard.

6. The invention of claim 4 wherein the material comprises corrugated paperboard.

7. The invention of claim 1 wherein the elastomeric enclosure comprises a polymeric film.

8. The invention of claim 7 wherein the polymeric film is attached to each of the two end panels by a fastener selected from the group consisting of staples, adhesives, stitches, and combinations thereof.

9. The invention of claim 7 wherein the elastomeric enclosure comprises a bellows-fold hammock.

10. The invention of claim 1 wherein at least a portion of a bottom surface of the elastomeric enclosure is attached to the first face of the product-supporting platform.

11. The invention of claim 1 wherein at least a portion of a bottom surface of the elastomeric enclosure is attached to the first face of the product-supporting platform with an adhesive.

12. The invention of claim 1 wherein the product-supporting platform comprises at least one perforation.

13. The invention of claim 1 wherein the product-supporting platform comprises a plurality of perforations configured to form a plurality of flaps, and wherein the flaps are configured to bend towards the second face of the product-supporting platform when a product rests thereon.

14. The invention of claim 13 wherein at least one of the flaps comprises a V-shape.

15. The invention of claim 13 wherein at least one of the flaps comprises a rectangular shape.

16. The invention of claim 1 wherein the product-supporting platform, the two end panels, the two side panels, and the two reinforcing flaps are formed from a single sheet of material.

17. The invention of claim 16 wherein the product-supporting platform, the two side panels, and the two reinforcing flaps are single-wall and the two end panels are double-wall.

18. The invention of claim 17 wherein the single sheet of material is folded along outer edges of the end panels, such that first and second opposed layers of the double-wall are formed.

19. The invention of claim 16 wherein the product-supporting platform and the two side panels are single-wall, wherein the two end panels are double-wall, and wherein the two reinforcing flaps are triple-wail.

20. The invention of claim 19 wherein the single sheet of material is folded along inner and outer edges of the end panels, such that first and second opposed layers of the double-wall are formed, and first, second, and third layers of the triple-wall are formed.

21. The invention of claim 16 wherein the product-supporting platform is single-wall, wherein the two side panels and the two end panels are double-wall, and wherein the two reinforcing flaps are triple-wall.

22. The invention of claim 1 wherein the product-supporting platform comprises at least one opening, and wherein the at least one opening is circular, square, triangular, rectangular or product-shaped.

23. A suspension package comprising:

a product-supporting platform having first and second opposed faces;

two end panels, each pivotally connected to a respective end of the product-supporting platform;

two reinforcing flaps, each pivotally connected to an inner edge of the end panels, wherein the reinforcing flaps are configured to contact the second face of the product-supporting platform;

two side panels, each pivotally connected to a respective side of the product-supporting platform; and an elastomeric enclosure comprising a polymeric film, wherein the elastomeric enclosure is selected from the group consisting of a C-fold hammock, an inverted C-fold hammock, a bellows-fold hammock, a pair of first and second film materials, and combinations thereof, and wherein the elastomeric enclosure is mounted between the two end panels and extends over the first face of the product-supporting platform; wherein the product-supporting platform, the two end panels, and the two side panels are formed from a single sheet of corrugated paperboard;

the two side panels are configured to pivot towards the first face of the product-supporting platform and to be configured substantially perpendicular thereto; and the two end panels are configured to pivot between an un-tensioned state and a tensioned state, wherein in the tensioned state, acute angles are configured to form between the second face of the product-supporting platform and each of the end panels, and wherein the end panels are configured to provide a spring action against a surface in contact therewith.

* * * * *